US011732383B2

(12) United States Patent
Amari et al.

(10) Patent No.: US 11,732,383 B2
(45) Date of Patent: *Aug. 22, 2023

(54) METHOD FOR MANUFACTURING FIBER DEPOSITION BODY, METHOD FOR MANUFACTURING FILM, AND METHOD FOR ATTACHING FILM

(71) Applicant: Kao Corporation, Tokyo (JP)

(72) Inventors: Naomi Amari, Ichikai-machi (JP); Masayuki Uchiyama, Chiba (JP); Yuko Wakahara, Narashino (JP); Tomonari Okada, Tsukuba (JP); Takehiko Tojo, Utsunomiya (JP); Hideo Kobayashi, Koto-ku (JP)

(73) Assignee: Kao Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/772,480

(22) PCT Filed: Oct. 26, 2020

(86) PCT No.: PCT/JP2020/040151

§ 371 (c)(1),
(2) Date: Apr. 27, 2022

(87) PCT Pub. No.: WO2021/085393

PCT Pub. Date: May 6, 2021

(65) Prior Publication Data

US 2022/0372662 A1 Nov. 24, 2022

(30) Foreign Application Priority Data

Oct. 28, 2019 (JP) ..... 2019-195658
Oct. 28, 2019 (JP) ..... 2019-195672
Oct. 28, 2019 (JP) ..... 2019-195709

(51) Int. Cl.
*D01D 7/00* (2006.01)
*D01D 5/00* (2006.01)

(52) U.S. Cl.
CPC ..... *D01D 7/00* (2013.01); *D01D 5/0061* (2013.01)

(58) Field of Classification Search
CPC ..... D01D 7/00; D01D 5/0061; D01D 5/0076; D01D 5/0046
See application file for complete search history.

(56) References Cited

U.S. PATENT DOCUMENTS 5,248,455 A * 9/1993 Joseph ..... D01D 5/0985 264/119
5,945,111 A * 8/1999 Esser ..... B05B 5/1608 424/47

(Continued)

FOREIGN PATENT DOCUMENTS

CN 101360521 A 2/2009
CN 102776583 A 11/2012

(Continued)

OTHER PUBLICATIONS

International Search Report dated Dec. 1, 2020 in PCT/JP2020/040151 filed on Oct. 26, 2020, 2 pages.

(Continued)

*Primary Examiner* — Emmanuel S Luk
(74) *Attorney, Agent, or Firm* — Oblon, McClelland, Maier & Neustadt, L.L.P.

(57) ABSTRACT

A fiber collection tool for collecting a fiber spun by electrospinning is described. The fiber collection tool has a size holdable by the hand of a user, and includes, in at least a portion of the surface thereof, an electroconductive section having a surface electrical resistivity of $10^{11}$ Ω/cm$^2$ or less, or a hydrophilic section having a water contact angle of preferably from 15° to 90° at 25° C. A user collects, with the (Continued)

fiber collection tool, a fiber spun by the user by electrospinning using an electrospinning device having a size holdable by the hand of the user, and thereby produces a film including a deposit of the fiber on a surface of the fiber collection tool. The fiber collection tool, having the deposit formed thereon, is pressed against a surface of an object, and the deposit is transferred onto the surface of the object, to form a film including the fiber deposit on the surface of the object.

21 Claims, 4 Drawing Sheets

(56) References Cited

U.S. PATENT DOCUMENTS 5,976,694 A 11/1999 Tsai et al.
6,074,869 A * 6/2000 Pall ..... B01D 61/18 422/429
6,135,369 A * 10/2000 Prendergast ..... B05B 5/0531 239/690
6,311,903 B1 * 11/2001 Gaw ..... A45D 34/00 239/708
6,514,504 B1 * 2/2003 Yen ..... A61K 8/8152 424/490
6,531,142 B1 * 3/2003 Rabe ..... A61K 8/29 424/490
7,105,058 B1 * 9/2006 Sinyagin ..... B05B 5/1691 118/62
11,161,126 B2 * 11/2021 Tojo ..... A61Q 1/02
2002/0102897 A1 * 8/2002 Berrigan ..... D01D 5/0985 156/244.19
2004/0094873 A1 * 5/2004 Dubson ..... A61L 27/56 427/457
2006/0083776 A1 * 4/2006 Bott ..... A61L 15/58 424/445
2007/0131805 A1 * 6/2007 Yamaguchi ..... B05B 5/005 239/690
2007/0199913 A1 8/2007 Kelley et al.
2009/0233057 A1 * 9/2009 Aksay ..... D01D 5/0038 427/469
2009/0311587 A1 * 12/2009 Best ..... H01M 50/105 429/127
2010/0018641 A1 1/2010 Branham et al.
2010/0093093 A1 4/2010 Leong et al.
2010/0152880 A1 * 6/2010 Boyden ..... A61K 51/1244 700/283
2011/0256397 A1 * 10/2011 Tojo ..... A61L 15/42 156/308.6
2012/0214375 A1 * 8/2012 Kitano ..... B01D 39/2065 423/447.2
2012/0301567 A1 * 11/2012 Pokorny ..... D01D 5/0076 425/174.8 E
2013/0122069 A1 * 5/2013 Tojo ..... A61K 8/027 424/443
2013/0125912 A1 * 5/2013 Tojo ..... D04H 1/43838 428/398
2013/0142852 A1 * 6/2013 Tojo ..... A61K 8/027 424/443
2013/0312638 A1 * 11/2013 Parker ..... D01D 5/0069 264/211.1
2014/0322515 A1 * 10/2014 Parker ..... D01D 5/0985 428/221
2015/0257828 A1 9/2015 Tankovich et al.
2018/0073165 A1 3/2018 Laidmäe et al.
2018/0317627 A1 * 11/2018 Fukuda ..... B05B 12/124
2019/0053602 A1 2/2019 Amari et al.
2019/0119830 A1 * 4/2019 Janssen ..... D04H 1/70
2019/0343731 A1 11/2019 Amari et al.
2020/0039837 A1 * 2/2020 Umebayashi ..... D01D 5/0015
2020/0263323 A1 * 8/2020 Sivler ..... D01F 13/00

FOREIGN PATENT DOCUMENTS

CN 202968788 U 6/2013
CN 105073091 A 11/2015
CN 107901398 A 4/2018
CN 207362375 U 5/2018
CN 209422513 U 9/2019
EP 3 218 536 B1 5/2019
JP 11-169231 A 6/1999
JP 2006-241629 A 9/2006
JP 2007-92210 A 4/2007
JP 2011-32613 A 2/2011
JP 2011-84843 A 4/2011
JP 2012-81164 A 4/2012
JP 2015-131875 A 7/2015
JP 2016-32780 A 3/2016
JP WO 2018/124227 A1 7/2018
JP 2020-179960 A 11/2020
KR 10-2016-0020262 A 2/2016
KR 10-2016-0020264 A 2/2016
KR 10-2017-0130500 A 11/2017
WO WO 01/26610 A1 4/2001
WO WO 2017/069079 A1 4/2017

OTHER PUBLICATIONS

U.S. Appl. No. 17/772,472, filed Apr. 27, 2022, Tomonari Okada, et al.

* cited by examiner

METHOD FOR MANUFACTURING FIBER DEPOSITION BODY, METHOD FOR MANUFACTURING FILM, AND METHOD FOR ATTACHING FILM

CROSS-REFERENCE TO RELATED APPLICATIONS

The present application is a 35 U.S.C. § 371 national stage application of International patent application PCT/JP2020/040151, filed Oct. 26, 2020, which is based on and claims the benefit of priority to Japanese Application No. 2019-195658, Japanese Application No. 2019-195672, and Japanese Application No. 2019-195709, each filed Oct. 28, 2019. The entire contents of these applications are incorporated herein by reference.

TECHNICAL FIELD

The present invention relates to a method for producing a fiber deposit, a method for producing a film, and a method for attaching a film.

BACKGROUND ART

Various techniques have been proposed for producing fibers and deposits thereof by electrospinning. For example, Patent Literature 1 discloses a method of using a woven fabric including an electroconductive material, and producing a fiber structure on the woven fabric by electrospinning. Patent Literature 2 discloses a method for producing a nanofiber film made from a polymer substance by using a collection sheet in which deposit regions, where fibers are to be deposited, and non-deposit regions, where fibers are not deposited, coexist on a target surface on which the nanofiber film is to be formed.

Patent Literature 3 discloses an electro-spraying device with which a solution material sprayed from a nozzle is deposited on a substrate as a thin film. The Patent Literature discloses that this device includes: the aforementioned nozzle for spraying the solution material in a voltage-applied state; and a mask arranged between the nozzle and the substrate in the vicinity of the substrate, the mask including a first mask portion and a second mask portion arranged separate from one another in a planar view and long narrow connection portions for connecting the first mask portion and the second mask portion and located separate from the substrate.

Applicant has previously proposed a coating formation method involving an electrostatic spraying step for electrostatically spraying, directly onto a coating formation target, a composition that contains a polymer having coating formability, to thereby form a coating constituted by a deposit including fibers (Patent Literature 4).

CITATION LIST

Patent Literature

Patent Literature 1: JP 2007-92210A
Patent Literature 2: JP 2011-84843A
Patent Literature 3: JP 2016-32780A
Patent Literature 4: WO 2018/124227

SUMMARY OF INVENTION

The present invention relates to a method for producing a fiber deposit, including: collecting a fiber with a fiber collection tool, the fiber being spun by a user by performing electrospinning using an electrospinning device; and producing a deposit of the fiber on a surface of the fiber collection tool.

In one embodiment, the fiber collection tool includes, in at least a portion of the surface thereof, an electroconductive section having a surface electrical resistivity of $10^{11}$ Ω/cm$^2$ or less; and the method involves collecting the fiber in the electroconductive section in a state where a portion of the user's body is in contact with a portion of the electroconductive section, or in a state where a portion of an electric conductor is in contact with the electroconductive section and a portion of the user's body is in contact with another portion of the electric conductor.

The present invention also relates to a method for producing a fiber laminate.

In one embodiment of the method, a user collects, with a fiber collection tool having a size holdable by the user's hand, a fiber spun by the user by performing electrospinning using an electrospinning device having a size holdable by the user's hand, and thereby produces a deposit of the fiber on a surface of the fiber collection tool.

One embodiment provides a method for producing a fiber deposit, wherein the fiber collection tool includes a hydrophilic section in at least a portion of the surface thereof, and has elasticity along a direction in which the fiber is collected and deposited.

The present invention also relates to a method for producing, on a surface of an object, a film including a fiber deposit.

In one embodiment, the method involves collecting, with a fiber collection tool, a fiber spun by a user by performing electrospinning using an electrospinning device, and forming a film including a deposit of the fiber on a surface of the fiber collection tool.

In one embodiment, the method involves pressing the fiber collection tool, having the film formed thereon, against a surface of an object and transferring the film onto the surface of the object, to form the film including the fiber deposit on the surface of the object.

The present invention also relates to a method for attaching a film.

In an embodiment, the method involves collecting a fiber with a fiber collection tool, the fiber being spun by a user by performing electrospinning using an electrospinning device, and forming a film including a deposit of the fiber on a surface of the fiber collection tool.

In an embodiment, the method involves pressing the fiber collection tool, having the film formed thereon, against a surface of an object and attaching the film onto the surface of the object.

DESCRIPTION OF EMBODIMENTS

Figure 1:
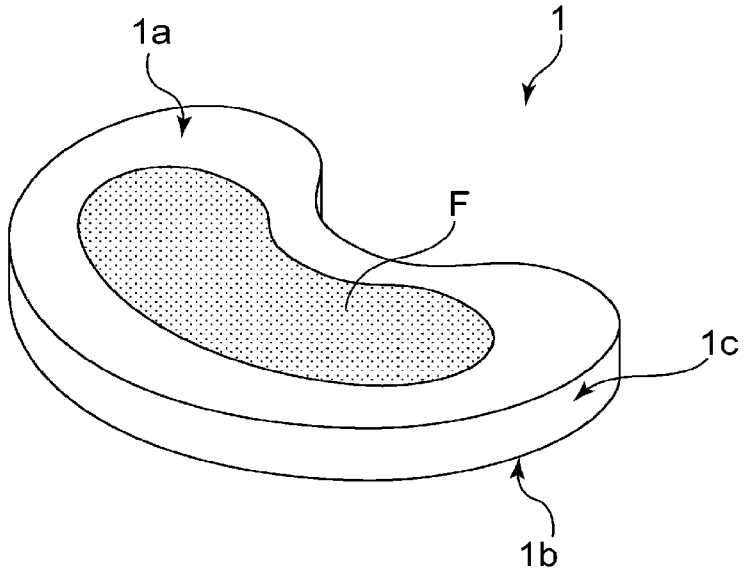
FIG. 1 is a perspective view schematically illustrating an embodiment of a fiber collection tool used in a production method according to the present invention.

Production of fiber deposits formed by electrospinning may be performed in non-industrial environments, such as at home, depending on the use thereof. Hence, there is a demand for a method with which electrospinning can be performed easily while maintaining fiber spinnability. Unfortunately, the techniques disclosed in Patent Literatures 1 to 3 use stationary electrospinning devices, and thus cannot perform electrospinning conveniently.

Further, such fiber deposits may be used for aesthetic purposes, such as for makeup or skin care. Particularly, from the viewpoint of achieving a desired finish in makeup and applying skin care in desired areas, it is also desirable that the user can produce a fiber deposit having a desired shape/size through the user's own operation. Unfortunately, the techniques disclosed in Patent Literatures 1 to 3 give no consideration to producing a fiber deposit through the user's own operation.

The method disclosed in Patent Literature 4 involves a method for performing electrospinning easily while maintaining fiber spinnability. However, no consideration is given to film-formation targets that can suitably be used for electrospinning, and there is still room for improvement in this regard.

Further, although Patent Literature 4 discloses a method in which electrospinning is directly performed on a surface of a target through the user's own operation, this method is hard to apply to areas, such as the eyes, where it is difficult to perform electrospinning directly, and there is still room for improvement also in this regard.

The present invention relates to a fiber deposit production method, a film production method, and a film attachment method capable of overcoming the drawbacks of conventional art.

The present invention will be described below according to preferred embodiments thereof with reference to the drawings. A fiber collection tool suitably usable in a production method or an attachment method according to the present invention is used to collect, preferably directly, a fiber spun by electrospinning. Electrospinning is a method for spinning a fiber, wherein: a positive or negative high voltage is applied to a material liquid containing a resin, which is a material of the fiber, to thereby charge the material liquid; and the charged material liquid is ejected toward an object. The ejected material liquid spreads out into space while repeatedly being stretched and becoming finer by Coulomb repulsion force, and fine fiber with a small fiber diameter is deposited on a surface of the object. In this way, a fiber deposit—preferably, a film including a fiber deposit—can be obtained. The material liquid will be described in detail further below.

The fiber collection tool has a size holdable in a hand of a user forming the fiber or the fiber deposit. Herein, "holdable by the hand" encompasses embodiments wherein the fiber collection tool is gripped and held with the hand, and also embodiments wherein the fiber collection tool is pinched and held with the fingers and embodiments wherein the fiber collection tool is placed on the palm, the back of the hand, etc., and held thereon.

The size of the fiber collection tool is not particularly limited so long as it is holdable by the hand, but it is preferable that the mass of the fiber collection tool is preferably 500 g or less, more preferably 200 g or less. The maximum length spanning the fiber collection tool is preferably from 0.1 mm to 30 cm. The volume of the fiber collection tool is preferably from 0.5 $cm^3$ to $10^4$ $cm^3$. The above is preferable because, in this way, the fiber collection tool can be held not only with one hand, but can also be placed on other areas such as the knee, and further, the fiber collection tool can easily be taken along and carried and also operated easily, thereby allowing fibers formed on the fiber collection tool to be easily applied or transferred to an application area with the hand.

The three-dimensional shape of the fiber collection tool is not particularly limited so long as the fiber spun by electrospinning can be collected, and may be, for example, a three-dimensional shape including a plurality of planar portions, a three-dimensional shape including a plurality of curved portions having different curvatures, or a three-dimensional shape including the aforementioned planar portions and curved portions. Concrete examples of three-dimensional shapes may include: prismatic shapes such as a triangular prism, a quadrangular prism, a pentagonal prism, etc.; circular cylindrical shapes such as a circular cylinder, an elliptic cylinder, etc.; pyramidal shapes such as a triangular pyramid, a quadrangular pyramid, a pentagonal pyramid, etc.; circular conic shapes such as a circular cone, an elliptic cone, etc.; convex polyhedrons such as an octahedron, a dodecahedron, etc.; non-convex polyhedrons such as a star-shaped polyhedron, etc.; and other three-dimensional shapes such as a plate shape, a sheet-like shape, a spherical shape, an ellipsoidal shape, a fan shape, a mesh shape, etc. In cases where the fiber collection tool has a three-dimensional shape having apexes, it is preferable that at least one apex is rounded.

The planar-view shape of the fiber collection surface of the fiber collection tool is also not particularly limited so long as the fiber spun by electrospinning can be collected, and may be, for example, a shape including a plurality of rectilinear portions in its contour, a shape including a plurality of curvilinear portions with different curvatures in its contour, or a shape including both the aforementioned rectilinear portions and curvilinear portions in its contour, Concrete examples may include: polygonal shapes such as a triangle, a quadrangle, a rhombus, a pentagon, etc.; circular shapes such as a semicircle, a perfect circle, an ellipse, etc.; and planar shapes including both curvilinear portions and rectilinear portions in its contour, such as a star shape, a crescentic shape, a lattice shape, etc. In cases where the fiber collection tool has a planar shape having apexes, at least one apex may be rounded. The fiber collection surface of the fiber collection tool 1 may be a flat surface or a curved surface at the time of spinning fibers. In eases where the fiber collection surface of the fiber collection tool 1 is a curved surface, it may be a convex shape projecting outward from the fiber collection tool 1, or may be a concave shape depressed inward into the fiber collection tool 1.

FIG. 1 schematically illustrates an embodiment of a fiber collection tool. The fiber collection tool 1 illustrated in the figure has a plate shape having surfaces constituted by: a pair of substantially flat principal surfaces 1*a*, 1*b*; and a side surface 1*c* intersecting with the principal surfaces. Preferably, one of the principal surfaces 1*a*, 1*b* is used as the fiber collection surface. The fiber collection tool 1 illustrated in the figure has a pair of crescentic principal surfaces 1*a*, 1*b* with rounded end portions. It is preferable that the fiber collection tool 1 has no corners, such as by rounding the apexes and ridgelines. The presence of a corner is likely to cause electric charge to concentrate thereon, whereas a shape with no corner suppresses electric charge from concentrating on a portion of the fiber collection tool 1, which facilitates fibers to be deposited uniformly on the fiber collection tool 1. A "corner" is a section formed by two plane surfaces, or a plane surface and a curved surface, intersecting with one another. In the fiber collection tool 1 of the present embodiment, the first principal surface 1*a* is used as the fiber collection surface, and a deposit of fiber, preferably a film F constituted by a deposit of fiber (referred to hereinafter simply as "fiber deposit" or "film"), is formed directly in a partial region of the first principal surface 1*a*. For the sake of explanation, hereinbelow, "fiber deposit" and "film" are treated as synonymous unless particularly stated otherwise.

It is preferable that the fiber collection tool 1 has one or a plurality of depressions in the surface thereof. The use of a fiber collection tool having depression(s) can reduce the contact area between the fiber collection tool 1 and the film F, and thereby, the film F formed on the surface of the fiber collection tool 1 can be peeled off from the fiber collection tool 1 easily, and transferability can be further improved. The depression may be a through hole, or a penetrating groove such as a slit. Alternatively, the depressions may be micropores in a porous body such as a sponge. For the material of the fiber collection tool including depressions, it is possible to use a porous body, for example. For the porous body, it is possible to use the examples described further below.

Herein, "transferability" means pressing the fiber deposit F (or film F) against an object and attaching the fiber deposit F (or film F) onto the object.

It is preferable that the fiber collection tool 1 has, on the surface thereof, a section including napped fiber. A "napped section" may be a section in which short fibers are fixed on the surface in a standing state. The use of a fiber collection tool having a napped section can reduce the contact area between the fiber collection tool 1 and the film F, and thereby, transferability can be further improved. An example of a fiber collection tool having a napped section includes a cosmetic puff subjected to electrostatic flocking.

It is preferable that an agent having an action of releasing the film F is applied to a surface of the fiber collection tool. Stated differently, the fiber collection tool has, on the surface thereof, an agent having an action of releasing the film F. Using such a fiber collection tool can further improve transferability. In this case, in the aforementioned method for forming the film F, an agent having an action of releasing the film F is applied in advance to the surface of the fiber collection tool. For example, the agent may be applied to a portion or the entire region of the collection surface of the fiber collection tool, and then the later-described method for producing the fiber deposit (film) may be performed.

From the viewpoint of further facilitating peeling of the film F from the fiber collection tool 1, it is preferable that the agent having a releasing action is a powdery agent. Examples of the powdery agent may include: inorganic powders, such as silicic acid, silicic acid anhydride, magnesium silicate, talc, sericite, mica, kaoline, colcothar, clay, bentonite, mica, titanium-coated mica, bismuth oxychloride, zirconium oxide, magnesium oxide, titanium oxide, zinc oxide, aluminum oxide, calcium sulfate, barium sulfate, magnesium sulfate, calcium carbonate, magnesium carbonate, iron oxide, ultramarine blue, chromium oxide, chromium hydroxide, calamine, carbon black, boron nitride, and composites thereof; organic powders, such as polyamide, nylon, polyester, polypropylene, polystyrene, polyurethane, vinyl resins, urea resins, phenolic resins, fluorocarbon resins, silicon resins, acrylic resins, melamine resins, epoxy resins, polycarbonate resins, divinylbenzene styrene copolymer, silk powder, cellulose, metal salts of long-chain alkyl phosphates, N-mono-long-chain alkyl acyl basic amino acids, and composites thereof; and composite powders including the aforementioned inorganic powder(s) and organic powder(s). The aforementioned powdery agents may be colored or non-colored (e.g., may be white or substantially transparent).

From the viewpoint of easily forming an electrical conduction path between the fiber collection tool 1 and a later-described electrospinning device 10 and improving the spinnability by electrospinning, it is preferable that the fiber collection tool 1 has one of the following configurations (1) to (3) for improving electroconductivity.

(1) The fiber collection tool 1 includes an electroconductive section in at least a portion of the surface thereof.

(2) The fiber collection tool 1 includes a hydrophilic section in at least a portion of the surface thereof.

(3) The fiber collection tool 1 includes an electroconductive section in the interior thereof.

An embodiment of the fiber collection tool 1 preferably includes an electroconductive section in at least a portion of the surface thereof (the aforementioned configuration (1)).

The electroconductive section of the present embodiment is a section for forming, during fiber spinning by electrospinning, an electrical conduction path between the fiber collection tool 1 held by the human hand and a later-described electrospinning device, to thereby enable fiber spinning by electrospinning. In addition, the electroconductive section of the present embodiment is a section on which the fiber spun by electrospinning is deposited.

The electroconductive section present on the surface of the fiber collection tool 1 may be formed continuously and uniformly over the surface of the fiber collection tool 1, or may be formed in only a portion of the surface of the fiber collection tool 1. In cases where the electroconductive section is formed in only a portion of the surface, it is preferable that the electroconductive section is formed continuously, and more preferably, formed so as to extend to a region, or vicinity thereof, that can be touched by a portion of the user's body. Note that this does not prevent the electroconductive section from also being formed inside the fiber collection tool 1.

From the viewpoint of improving fiber spinnability of by electrospinning and performing spinning of fiber easily, it is preferable that the fiber collection tool 1 has electroconductive sections respectively on the fiber collection surface and at the section to contact the user's body, and it is further preferable that the electroconductive section on the fiber collection surface is formed continuously with the electroconductive section at the section to contact the user's body, and it is even more preferable that the electroconductive section is formed continuously over the entire region of the surface of the fiber collection tool 1. Forming the electroconductive section continuously over the entire region of the surface of the fiber collection tool 1 is advantageous, in that spinning and depositing of fiber can be performed even more easily, because there is no need to particularly take into consideration the orientation of the fiber collection tool 1 during electrospinning or the position in which the fiber collection tool 1 is held.

The electroconductive section present on the surface of the fiber collection tool 1 preferably has a surface electrical resistivity value of preferably $10^{11}$ Ω/cm$^2$ or less, more preferably $8.0\times10^{10}$ Ω/cm$^2$ or less, even more preferably $5.0\times10^{10}$ Ω/cm$^2$ or less, even more preferably $10^{10}$ Ω/cm$^2$ or less; the lower the value is, the more preferable. However, the surface electrical resistivity value is realistically $10^0$ $\Omega/cm^2$ or greater. By having such surface electrical resistivity, spinning of fiber by electrospinning can be performed efficiently, and the fiber deposit can be formed in a desired position of the fiber collection tool 1. Such an electroconductive section can be formed, for example, by using the later-described material, or by subjecting the surface of the material to a treatment to increase electroconductivity. The surface electrical resistivity of the electroconductive section may be the same among various electroconductive sections, or may be different among various electroconductive sections within the aforementioned range of surface electrical resistivity.

From the viewpoint of easily enabling spinning of fiber by electrospinning, it is further preferable that the surface electrical resistivity value of the fiber collection tool 1 is within the aforementioned range at any discretionary position on the surface thereof. Stated differently, it is further preferable that the electroconductive section having a surface electrical resistivity within the aforementioned range is formed continuously over the entire region of the surface of the fiber collection tool 1.

The surface electrical resistivity can be measured, for example, according to the method of JIS K6911 (1995). More specifically, a measurement sample is obtained by cutting a fiber collection tool 1 being measured such that the surface in which the surface electrical resistivity is to be measured is 50 mm long and 45 mm wide, and the thickness is 4 mm. The measurement sample's surface to be measured is brought into contact with an inner electrode and a ring electrode of a Chamber R12704 from Advantest Corporation, so as to bridge the inner electrode and the ring electrode. In this state, using an electrical resistance meter R8340A from Advantest Corporation in Surface mode, a voltage is applied to the electrodes such that the potential difference between the chamber's electrodes becomes 500 V, and the resistivity ($\Omega/cm^2$) is measured. Measurement is performed in a temperature-humidity environment at room temperature of 22 to 23° C. and a relative humidity of 46%.

Another embodiment of the fiber collection tool 1 preferably includes a hydrophilic section in at least a portion of the surface thereof (aforementioned configuration (2)).

The hydrophilic section is a section having hydrophilicity, i.e., a section having affinity for water and having water absorbable/retainable properties. The hydrophilic section has, for example, a water contact angle of 90° or less at 25° C. Including such a hydrophilic section will increase the electroconductivity of the fiber collection tool 1, thus making it possible to improve fiber spinnability by electrospinning through an electrical conduction path formed between the fiber collection tool 1 and a later-described electrospinning device.

Herein, "spinnability" refers to formation of fiber from a fiber material liquid and depositing of the fiber onto a target position.

From the viewpoint of depositing the spun fiber onto the fiber collection tool 1 more effectively, it is preferable that the hydrophilic section has a water contact angle at 25° C. of preferably 15° or greater, more preferably 18° or greater, and preferably from 15° to 90°, more preferably from 18° to 90°.

The contact angle between the hydrophilic section and water may be the same among various hydrophilic sections, or may be different among various hydrophilic sections within the aforementioned range of water contact angle. The contact angle with water at 25° C. is measured according to the following method.

Method for Measuring Contact Angle at 25° C.:

The measurement environment is set to air temperature of 25° C. and relative humidity of 50±5% RH. A 0.5-μL droplet of ion-exchanged water is dropped onto a surface of the fiber collection tool for which the contact angle is to be measured, and the liquid droplet is video-recorded from a side where the interface between the liquid droplet and the surface being measured can be viewed. The contact angle is measured based on the recorded image. For the measurement device, for example, an automatic contact angle meter, DM501Hi from Kyowa Interface Science Co., Ltd., is used. An image in which the contour of the liquid droplet is clear is selected from among images obtained after 20 seconds from liquid dropping, and in the selected image, the contact angle of the liquid droplet is measured based on a reference surface, to find the water contact angle at 25° C.

In cases where the fiber collection tool has micropores in its surface, as in a porous body etc., it may not be possible to measure the contact angle of the fiber collection tool stably. In such cases, an article made from the same material as the material forming the fiber collection tool but having no micropores in its surface is used for the measurement, instead of the fiber collection tool.

From the viewpoint of improving electroconductivity and also improving fiber spinnability, it is preferable that the hydrophilic section has water absorbency. More specifically, the water absorption time of the hydrophilic section when 0.1 mL of water is dropped at 25° C. is preferably from 0 seconds to 4 hours, more preferably from 0 seconds to 3.5 hours, even more preferably from 0 seconds to 2.25 hours.

Method for Measuring Water Absorption Time at 25° C.:

The method is performed with reference to Water Absorption Rate (Dropping Method) in "Testing Methods for Water Absorbency of Textiles" in the Japanese Industrial Standard (JIS L 1907:2004). The measurement environment is set to air temperature of 25° C. and relative humidity of 50±5% RH. A summary of the measurement method is as follows. A 0.1-mL droplet of ion-exchanged water is dropped onto a measurement surface of the fiber collection tool where water is to be absorbed, and an image of the liquid droplet on the measurement surface is captured from above, to measure the water absorption time based on the captured image. The light source used for the observation is a fluorescent lamp (brightness: 500 to 1000 lx) with which the specular reflection of water can be observed with the eyes.

First, a paper napkin is placed on a flat plastic tray, and the fiber collection tool is placed thereon with the measurement surface facing upward. The fiber collection tool is made into a test piece having a size of 40×50×20 mm, and 0.1 mL of water is dropped with a micropipette (Eppendorf Multipette M4 (registered trademark)) from a distance of around 1 cm from the fiber collection tool. A timer is used to measure, by seconds, the length of time from when the water droplet reaches the surface of the test piece to when the specular reflection disappears and only moisture remains due to the water droplet being absorbed by the test piece. Note that, in cases where water is not absorbed even after 6 hours, it is determined that measurement is not possible because the water droplet evaporates spontaneously, and "Over 6 hours" is recorded as the measurement result.

The hydrophilic section having the aforementioned properties can be formed, for example, by using the later-described materials, or by subjecting the surface of the material to a treatment to increase hydrophilicity.

The hydrophilic section of the fiber collection tool 1 may be formed over the entire region of the surface of the fiber collection tool 1, or may be formed in a portion of the surface of the fiber collection tool 1. From the viewpoint of further improving fiber spinnability, in cases where the hydrophilic section is formed in a portion of the surface of the fiber collection tool 1, it is preferable that the hydrophilic section is formed on the surface of the fiber collection tool 1 where the spun fibers are collected and deposited. For example, in the fiber collection tool 1 of the present embodiment, it is preferable that the hydrophilic section is formed on one of the pair of principal surfaces 1*a*, 1*b*, and more preferable that the hydrophilic section is formed on both the principal surfaces 1*a*, 1*b*.

From the viewpoint of easily collecting fiber by electrospinning, it is further preferable that the water contact angle of the fiber collection tool 1 is within the aforementioned range at any discretionary position on the surface thereof. Stated differently, it is further preferable that the hydrophilic section having a water contact angle within the aforementioned range is formed continuously over the entire region of the surface of the fiber collection tool 1.

Examples of constituent materials for the fiber collection tool 1 having the aforementioned configuration may include fiber sheets, films, porous bodies, elastic bodies, etc. One of these materials may be used singly, or a plurality of these materials may be used in combination.

Examples of fiber sheets may include various nonwoven fabrics, woven fabrics, knitted fabrics, paper, mesh sheets, and laminates thereof.

Examples of films may include mesh films made from resin materials, such as polyethylene and polypropylene, and various film sheets.

Examples of porous bodies may include foams, with concrete examples including foams including, as a material, polyurethane, wet urethane, acrylonitrilebutadiene copolymer (NBR), styrenebutadiene copolymer (SBR), natural rubber (NR), ethylenepropylenediene copolymer (EPDM), melamine foam, polyvinyl alcohol (PVA), cellulose, etc.

Examples of elastic bodies may include rubber products and elastomer products, with concrete examples including rubber-made meshes, various rubber sheets, and foamed rubber (rubber sponges) including, as a material, one or more rubber-like substances such as natural rubber, synthetic rubber, silicone rubber, acrylic rubber, urethane rubber, nitrile rubber, etc.

The aforementioned materials may be used as is, or the materials may include an electroconductive material made, for example, by subjecting at least a surface of the material to a treatment for increasing electroconductivity, such as a hydrophilizing treatment or an electroconductive treatment. Examples of treatments for increasing electroconductivity may include: mixing, coating or immersion of the aforementioned material with/in a liquid electroconductive material such as water, a surfactant, etc.; and mixing or coating of a solid electroconductive material such as copper, carbon, etc. The hydrophilizing treatment will be described further below.

Among the various types of materials described above, it is preferable that the fiber collection tool 1 includes a porous material, and is more preferably a monolithic molded body of a porous material. This structure is advantageous in that the film including a fiber deposit can be deposited on the surface of the fiber collection tool 1 in a manner easily peelable from the fiber collection tool 1. The contact area between the pores formed in the porous material's surface and the deposited fiber is reduced, and thus, the fiber deposit F formed on the surface of the fiber collection tool 1 can be peeled off easily from the fiber collection tool 1, thus improving the productivity of the fiber deposit F.

Examples of usable porous materials may include the aforementioned fiber sheets and porous bodies, as well as materials obtained by subjecting these to a treatment for improving electroconductivity, so that the material includes an electroconductive material in the surface and/or interior thereof. From the viewpoint of easily forming the hydrophilic section, it is also preferable that these materials are subjected to a hydrophilizing treatment. The fiber collection tool 1 may include a plurality of molded bodies of porous materials in combination, so long as the effects of the present invention are achieved. In this case, it is preferable that the electroconductive sections or hydrophilic sections of the respective molded bodies are electrically connected.

It is preferable that the fiber collection tool 1 includes an elastic material, and is more preferably a monolithic molded body of an elastic material. With this structure, the shape of the fiber collection tool 1 can be deformed easily by application of gripping force, while maintaining excellent fiber spinnability. So, by changing the shape of the fiber collection surface, spinning can be performed so that the range for forming the fiber deposit and the planar shape thereof can take on a desired range and shape.

Examples of elastic materials may include the aforementioned fiber sheets, porous bodies, and elastic bodies, as well as materials obtained by subjecting these to a treatment for improving electroconductivity, so that the material includes an electroconductive material in the surface and/or interior thereof. The fiber collection tool 1 may include a plurality of molded bodies of elastic materials in combination, so long as the effects of the present invention are achieved. In this case, it is preferable that the electroconductive sections or hydrophilic sections of the respective molded bodies are electrically connected.

Particularly, it is preferable that the material for the fiber collection tool 1 is, for example, a laminate formed by layering fiber sheets, a porous body, or an elastic material such as rubber. One of these materials may be used singly, or a plurality of these materials may be used in combination. These materials may be used as is, or a material obtained by subjecting at least a surface of the aforementioned material to the aforementioned hydrophilizing treatment may be used.

Particularly, it is preferable that the fiber collection tool 1 includes a porous and elastic material, and is more preferably a monolithic molded body of such a material. With this structure, the contact area between the fiber collection tool 1 and the deposited fiber is reduced by the pores formed in the surface of the porous material, and thus, the fiber deposit formed on the surface of the fiber collection tool 1 can be peeled off easily from the fiber collection tool 1, thus improving the productivity of the fiber deposit. In addition, by using an elastic material, the shape of the fiber collection tool 1 can be deformed easily by application of gripping force, while maintaining excellent fiber spinnability. So, by changing the shape of the fiber collection surface, spinning can be performed so that the range for forming the fiber deposit and the planar shape thereof can take on a desired range and shape. Examples of such a porous and elastic material may include porous bodies such as foams, e.g., polyurethane, wet urethane, acrylonitrilebutadiene copolymer (NBR), melamine foam, etc., as well as materials obtained by subjecting these to a treatment for improving electroconductivity, so that the material includes an electroconductive material in the surface and/or interior thereof.

The fiber collection tool 1 may include, in combination, a plurality of molded bodies of elastic materials constituted by porous materials, so long as the effects of the present invention are achieved. In this case, it is preferable that the electroconductive sections or hydrophilic sections of the respective molded bodies are electrically connected.

In cases where the fiber collection tool 1 includes a porous material, pores formed in the porous material may be connected (open) pores, independent (closed) pores, or a combination thereof. In either case, the pore diameter of the porous material is preferably 10 μm or greater, more preferably 20 μm or greater, and preferably 1000 μm or less, more preferably 900 μm or less. For example, the pore diameter can be measured by: observing the material with, for example, a scanning electron microscope (SEM) under a magnification of 500×; discretionarily choosing 10 porous holes (pores) from the two-dimensional image; directly reading off the maximum lengths thereof; and finding the arithmetic mean value thereof as the pore diameter.

The apparent density of the porous material is preferably 0.001 g/cm$^3$ or greater, more preferably 0.005 g/cm$^3$ or greater, and preferably 10 g/cm$^3$ or less, more preferably 5 g/cm$^3$ or less. For example, the apparent density can be measured by: finding the mass (g) of the sample with a device capable of measuring mass up to 0.001 g; also measuring, with vernier calipers, dimensions necessary for calculating the volume, such as the sample's diameter or area and the sample's thickness under no-load, and calculating the sample's volume (cm$^3$); and calculating the apparent density of the porous material by the formula "mass (g)/volume (cm$^3$)".

From the viewpoint of easily deforming the shape of the fiber collection tool 1, it is further preferable that the fiber collection tool 1 has elasticity along a direction in which the spun fiber is collected and deposited. For example, the fiber collection tool 1 of the present embodiment has elasticity along the thickness direction.

In cases where the fiber collection tool 1 includes an elastic material, the hardness of the material is preferably 1 or greater, more preferably 5 or greater, and preferably 95 or less, more preferably 90 or less, as measured with a rubber hardness meter. For example, the material hardness can be measured by: bringing a pressurizing surface of an indentor of a rubber hardness meter (ASKER Type FP) perpendicularly into contact with a side surface of a test piece at 20° C., 50% RH; applying pressure for 3 seconds in this state; and reading the meter scale at that time. A material is considered as "having elasticity" in cases where the hardness measured by the rubber hardness meter has the aforementioned value.

From the viewpoint of forming the hydrophilic section more easily, it is preferable that a material for forming the fiber collection tool 1 is subjected to a hydrophilizing treatment. For the hydrophilizing treatment, it is possible to employ any known method, such as mixing, coating or immersion of the material forming the fiber collection tool 1 with/in a hydrophilic base material or a surfactant. The hydrophilizing treatment may be a pre-treatment performed before forming the fiber collection tool 1, or may be a post-treatment performed after forming the fiber collection tool 1. An example of a method for performing the hydrophilizing treatment as a pre-treatment may include a method disclosed in JP 2015-131875A, wherein a surfactant, such as an aliphatic diester compound, is added to a material for forming the fiber collection tool 1, and then the fiber collection tool 1 is molded. Examples of methods for performing the hydrophilizing treatment as a post-treatment may include methods disclosed in JP S63-268751A and JP H1-81834A, wherein the formed fiber collection tool 1 is immersed in an aqueous solution containing a hydrophilic base material, such as polyethylene glycol·dimethacrylate, and then heating the same, to graft-polymerize the hydrophilic base material onto the material forming the fiber collection tool 1.

Examples of surfactants may include cationic surfactants, anionic surfactants, amphoteric surfactants, nonionic surfactants, etc.

Examples of cationic surfactants may include: alkyl trimethyl ammonium bromides selected from, for example, cetyl trimethyl ammonium bromide, behenyl trimethyl ammonium chloride, distearyl dimethyl ammonium chloride, tricetyl methyl ammonium chloride, and stearyl dimethyl benzyl ammonium chloride; alkyl dimethyl ammonium chlorides selected from, for example, dicetyl dimethyl ammonium chloride, distearyl dimethyl ammonium chloride, diaralkyl dimethyl ammonium chloride, and dibehenyl dimethyl ammonium chloride; quaternary ammonium salts such as benzalkonium chloride; and dimethyl distearyl ammonium salts.

Examples of anionic surfactants may include: fatty acid salts derived from fatty acids having 8 or more carbon atoms, such as sodium laurate, potassium palmitate, etc.; alkyl sulfate salts such as sodium lauryl sulfate, potassium lauryl sulfate, sodium stearyl sulfate, etc.; alkyl ether sulfate salts such as triethanolamine polyoxyethylene lauryl sulfate, etc.; N-acyl sarcosine salts such as lauroyl sarcosine sodium salt, etc.; N-acyl methyl taurine salts such as N-myristoyl-N-methyltaurine sodium salt, etc.; N-acyl fatty acid glutamate salts such as sodium N-myristoyl-L-glutamate, disodium N-stearoyl glutamate, monosodium N-lauroyl myristoyl-L-glutamate, triethanolamine N-cocoyl glutamate, etc.; sulfosuccinate salts such as sodium di-2-ethylhexyl sulfosuccinate, etc.; and polyoxyethylene alkyl ether phosphate salts such as sodium polyoxyethylene cetyl ether phosphate, etc.

Examples of amphoteric surfactants may include stearyl betaine, lauryl betaine, etc.

Examples of nonionic surfactants may include: ethylene glycol fatty acid esters such as ethylene glycol monostearate, etc.; polyethylene glycol fatty acid esters such as polyethylene glycol (2) monostearate, etc.; polyalkylene glycol alkyl ethers such as polyethylene glycol (5) decyl pentadecyl ether, etc.; polyethylene glycol hydrogenated castor oil such as polyethylene glycol (5) hydrogenated castor oil monoisolaurate, etc.; propylene glycol fatty acid esters; monoglycerin mono-fatty acid esters such as glycerin monoisostearate, etc.; monoglycerin di-fatty acid esters such as glycerin distearate, glycerin dilaurate, etc.; glycerin alkyl ethers such as glycerin monoisostearyl ether, etc.; sorbitan fatty acid esters such as sorbitan monostearate, etc.; fatty acid dialkanol amides such as fatty acid alkanolamides, lauric acid diethanolamide, etc.; and polyoxyethylene sorbitan fatty acid esters such as polyoxyethylene sorbitan monostearate, etc.

One type of surfactant selected from the above may be used, or two or more types may be used in combination.

From the viewpoint of providing the hydrophilic section with a water contact angle within the aforementioned range more reliably, it is preferable that a surfactant is present in the fiber collection tool 1. From the same viewpoint as described above, the content of the surfactant in the fiber collection tool 1 is preferably 0.01 mass % or greater, more preferably 0.05 mass % or greater, and preferably 35 mass % or less, more preferably 30 mass % or less, and preferably from 0.01 to 35 mass %, more preferably from 0.05 to 30 mass %.

Another embodiment of the fiber collection tool 1 preferably includes an electroconductive section in the interior thereof (aforementioned configuration (3)).

Figure 2:
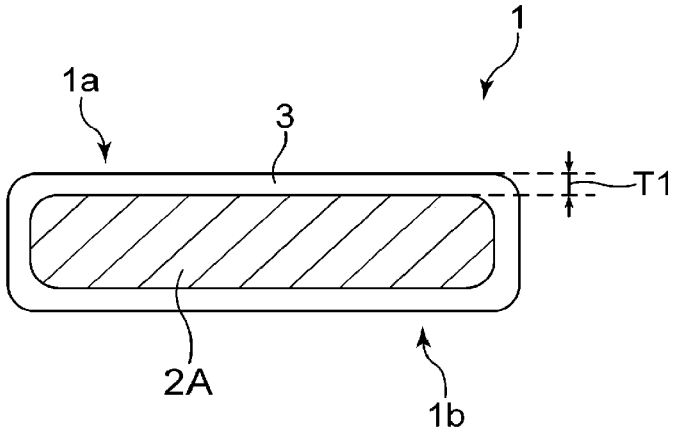
FIG. 2 is a cross-sectional view schematically illustrating another embodiment of a fiber collection tool used in a production method according to the present invention.

An embodiment of the present configuration (3) is schematically illustrated in FIG. 2. The electroconductive section in the present embodiment is a section for forming, during fiber spinning by electrospinning, an electrical conduction path between the fiber collection tool 1 held by the human hand and an electrospinning device, to thereby enable fiber spinning by electrospinning, even in cases where surface sections are non-electroconductive.

The electroconductive section 2A in the present configuration (3) is a section that occupies a large portion of the fiber collection tool 1, and more specifically, occupies preferably 60 vol % or greater, more preferably 80 vol % or greater, or even 100 vol %, with respect to the volume of the fiber collection tool 1. In cases where the later-described surface section 3 is provided, the percentage of the electroconductive section 2A with respect to the volume of the fiber collection tool 1 is preferably 95 vol % or less.

The electroconductive section 2A present in the interior of the fiber collection tool 1 according to the present configuration (3) may be formed continuously over the entire region in the interior of the fiber collection tool 1 as illustrated in FIG. 2, or alternatively, may be formed in only a partial region of the interior of the fiber collection tool 1. In cases where the electroconductive section 2A is formed only in a portion of the interior, the electroconductive section 2A may be formed continuously, or a plurality of electroconductive sections 2A may be formed in a scattered manner, or a combination thereof may be employed.

From the viewpoint of causing the spun fiber to be deposited in a predetermined position, it is preferable that the electroconductive section 2A is positioned so as to include the barycenter of the fiber collection tool 1. Note, however, that another electroconductive section may be present outside the electroconductive section 2A so long as electrospinning can be performed.

The fiber collection tool 1 according to the present configuration (3) has a volume electrical resistivity of preferably $10^{10}$ Ω·cm or less, more preferably $5\times10^{9}$ Ω·cm or less, even more preferably $10^{9}$ Ω·cm or less; the lower the value is, the more preferable. However, the volume electrical resistivity is realistically $10^{0}$ Ω·cm or greater. By having such volume electrical resistivity, spinning of fiber by electrospinning can be performed efficiently, and the fiber deposit can be formed in a concentrated manner in a desired position of the fiber collection tool 1, thus offering excellent targeting properties. For such a fiber collection tool 1, it is possible to use, for example, a later-described material for the electroconductive section 2A, or a material obtained by subjecting the material to a treatment for improving electroconductivity may be used for the electroconductive section 2A. The electroconductive section 2A may be formed from two or more different sections, on condition that the volume electrical resistivity satisfies the aforementioned value.

The volume electrical resistivity can be measured, for example, according to the following method. First, the fiber collection tool 1 to be measured is sandwiched between an inner electrode and a counter electrode opposing the inner electrode in a chamber R12704 from Advantest Corporation with a pressure of 1 N/cm$^2$ applied thereto. Then, using an electrical resistance meter R8340A from Advantest Corporation in Volume mode, a voltage is applied to the electrodes such that the potential difference between the chamber's electrodes becomes 500 V, and the volume electrical resistivity (Ω·cm) is measured. Measurement is performed in a temperature-humidity environment at room temperature of 22 to 23° C. and a relative humidity of 46%.

In the present configuration (3), from the viewpoint of improving fiber spinnability by electrospinning and also improving peelability of the spun fiber from the fiber collection tool 1, it is preferable that, as illustrated in FIG. 2, the fiber collection tool 1 has a surface section 3 formed on the outside of the electroconductive section 2A. The surface section 3 in the present configuration (3) preferably has a volume electrical resistivity different from the volume electrical resistivity of the electroconductive section 2A. For example, in cases where the surface section 3 is formed in multi-layer form by a plurality of materials, the volume electrical resistivity may be measured from the interior of the fiber collection tool 1 toward the outside to find a boundary where the measurement value changes for the first time, and the inside of the boundary may be considered the electroconductive section 2A whereas the outside thereof may be considered the surface section 3.

The surface section 3 of the present configuration (3) is preferably formed on the fiber collection surface, and more preferably, formed on each of the collection surface and a section to contact the user's body. It is even more preferable that the surface section 3 on the fiber collection surface and the surface section 3 at the section to contact the user's hand are formed continuously, and even more preferably, the surface section 3 is formed continuously over the entire region of the surface of the fiber collection tool 1. Particularly, forming the surface section 3 continuously over the entire region of the surface of the fiber collection tool 1 is advantageous, in that spinning and depositing of fiber can be performed even more easily, because there is no need to particularly take into consideration the orientation of the fiber collection tool 1 during electrospinning or the position in which the fiber collection tool 1 is held. In cases where the surface section 3 is formed continuously over the entire region of the surface of the fiber collection tool 1, it is preferable that the surface section 3 is formed by an electroconductive material satisfying the aforementioned conditions.

The electroconductive section 2A of the present configuration (3) may be formed from a single material, or may be formed by using a plurality of materials in combination, so long as electrospinning can be performed. In cases where the electroconductive section 2A is formed by using a plurality of materials in combination, the materials may be mixed such that the boundary therebetween is clear or unclear, or may be arranged in layers. In this case, it is preferable that the materials constituting the electroconductive section 2A are electrically connected.

Similarly, the surface section 3 of the present configuration (3) may be formed from a single material, or may be formed by using a plurality of materials in combination, so long as electrospinning can be performed. In cases where the surface section 3 is formed by using a plurality of materials in combination, the materials may be mixed such that the boundary therebetween is clear or unclear, or may be arranged in layers. The surface section 3 may be a combination of an electroconductive material and a non-electroconductive material, so long as electrospinning can be performed.

In cases where a surface section 3 is formed in the fiber collection tool 1 of the present configuration (3), the surface electrical resistivity of the surface section 3 is preferably greater than $10^{11}$ Ω/cm$^2$, more preferably $1.1\times10^{11}$ Ω/cm$^2$ or greater, and is realistically $500\times10^{12}$ Ω/cm$^2$ or less from the viewpoint of securing electroconductivity of the entire fiber collection tool 1. By providing the surface section 3 with such surface electrical resistivity, spinning of fiber by electrospinning can be performed efficiently even in cases where the surface section 3 is formed on the fiber collection tool 1, and a film F can be formed in a desired position of the surface section 3. Such a surface section 3 can be formed, for example, by using the later-described material. The surface electrical resistivity of the surface section 3 may be the same at any discretionary position of the surface section 3, or may be different among various surface sections 3 within the aforementioned range of surface electrical resistivity. The surface electrical resistivity is measured according to the aforementioned method.

Examples of materials for forming the fiber collection tool 1 having the aforementioned configuration (3) may include: solids, such as fiber sheets, metals, conductive carbon, rubber, films, porous bodies, etc.; and fluids including liquids such as water, oil, etc., and gases such as air, etc. One type of the aforementioned material may be used singly, or a plurality of types may be used in combination, so long as electrospinning can be performed. The aforementioned three states—i.e., solid, liquid, and gas—are determined based on the state of a substance at 20° C.

As regards solid materials for forming the fiber collection tool 1 having the aforementioned configuration (3), examples of fiber sheets may include various nonwoven fabrics, woven fabrics, knitted fabrics, paper, mesh sheets, and laminates thereof, made by using, as a raw material, a natural fiber such as pulp, cotton, hemp, silk, etc., or fiber containing a thermoplastic resin such as polyethylene, polypropylene, etc. Examples of metals may include metal-made meshes and various sheets made by using, as a raw material, copper, aluminum, stainless steel, etc. An example of conductive carbon may include graphite etc. Examples of rubber may include rubber-made meshes and various rubber sheets made by using, as a raw material, a rubber-like substance such as nitrile rubber, natural rubber, etc. Examples of usable films and porous bodies may include the examples given in the description of the aforementioned configuration (1). The aforementioned materials may be used as is, or it may be possible to use a material obtained by subjecting at least a surface of the aforementioned material to a treatment for increasing electroconductivity, such as a hydrophilizing treatment or an electroconductive treatment, or to a treatment for reducing electroconductivity, such as a hydrophobizing treatment. Examples of treatments for increasing electroconductivity may include: mixing, coating or immersion of the aforementioned material with/in water, a surfactant, a salt, etc.; and mixing or coating of an electroconductive material such as copper, carbon, etc. Examples of treatments for reducing electroconductivity may include mixing, coating, etc., of the aforementioned material with a non-electroconductive material.

Examples of fluids for forming the fiber collection tool 1 having the aforementioned configuration (3) may include: liquids such as water—e.g., ion-exchanged water, tap water (clean water), distilled water, ion-exchanged water, RO water, ultrapure water, etc. silicone oils, vegetable oils, etc.; and gases such as air, helium gas, etc. A solid may be present in the fluid, so long as electrospinning can be performed.

In cases where the fiber collection tool 1 having the aforementioned configuration (3) does not have the aforementioned surface section 3 or has a surface section 3 deformable by external force, it is preferable that the electroconductive section 2A constituting the fiber collection tool 1 is made from a material deformable by external force applied by the user's grip when the user grips the fiber collection tool 1. With this structure, the shape of the electroconductive section 2A can be deformed by application of gripping force, while maintaining excellent fiber spinnability. So, by changing the shape of the fiber collection surface, spinning can be performed so that the range for forming the fiber deposit and the planar shape thereof can take on a desired range and shape. The electroconductive section 2A may include, in combination, a plurality of molded bodies of materials deformable by external force. In this case, it is preferable that the electroconductive sections 2A of the respective molded bodies are electrically connected.

Examples of the electroconductive section 2A made from a material deformable by external force may include one or more of the aforementioned solids such as the aforementioned fiber sheets, rubber, porous bodies, etc., liquids, gases, and matters obtained by subjecting these to a treatment for improving electroconductivity. In cases where the electroconductive section deforms by external force applied by the user's grip, the deformation of the material constituting the electroconductive section 2A may be plastic deformation or elastic deformation.

In cases where the fiber collection tool 1 is provided with a surface section 3, it is preferable that the surface section 3 is made from a material deformable by external force applied by the user's grip when the user grips the fiber collection tool 1, and more preferably includes an elastic material, and even more preferably is a monolithic molded body of the aforementioned material. With this structure, when a film F including the fiber deposit produced on the fiber collection tool 1 is to be applied onto an adhesion object, application can be achieved without harming the adhesion object. In addition, by using a soft material, the film F can be pressed against the adhesion object, which can thus increase the area of contact between the film F and the adhesion object and improve the tight-adhesiveness of the film F. Examples of such materials may include one or more of solids, such as the aforementioned fiber sheets, rubber, porous bodies, etc., and materials obtained by subjecting these to a treatment for reducing electroconductivity. The surface section 3 may be a combination of a plurality of molded bodies of elastic material(s).

Particularly, it is preferable that both the electroconductive section 2A and the surface section 3 are made of a material deformable by external force applied by the user's grip when the user grips the fiber collection tool 1. With this structure, the entire fiber collection tool 1 can deform by external force applied by the user's grip. As a result, the shape of the fiber collection tool 1 can be deformed easily by application of gripping force. So, by easily changing the shape of the fiber collection surface, spinning can be performed so that the range for forming the fiber deposit and the planar shape thereof can take on a desired range and shape. In addition, when the fiber deposit produced on the fiber collection tool 1 is to be applied onto an adhesion object, the area of contact between the film F and the adhesion object can be increased, thereby improving the tight-adhesiveness of the film F.

In cases where the fiber collection tool 1 includes an elastic material, it is preferable that the hardness of the material measured with a rubber hardness meter (ASKER Type FP) at 20° C., 50% RH is within the same range as the fiber collection tool according to the aforementioned configuration (1) or (2).

In cases where the fiber collection tool 1 has a surface section 3, suitable combinations between materials for the electroconductive section 2A and the surface section 3 may be as described below, for example. The combination, however, can be varied as appropriate depending on, for example, the environment for performing electrospinning, the shape, area, etc. of the intended film F, and the like.

More specifically, examples of suitable combinations between the material for the electroconductive section 2A and the material for the surface section 3 (electroconductive section's material/surface section's material) may include: metal/nonwoven fabric; ion-exchanged water/nitrile rubber; ion-exchanged water/nitrile rubber and woven fabric; ion-exchanged water/nitrile rubber and nonwoven fabric; ion-exchanged water/nitrile rubber and paper.

In cases where the fiber collection tool 1 has a surface section 3, suitable combinations of arrangements of the electroconductive section 2A and the surface section 3 may be as described below, for example. The combination, however, can be varied as appropriate depending on, for example, the environment for performing electrospinning, the shape, area, etc. of the intended film F, and the like. More specifically, examples may include: a configuration wherein a nonwoven fabric-made surface section 3 is formed on the surface of a metal-made electroconductive section 2A; a configuration wherein a nitrile rubber-made surface section 3 is formed on the surface of an electroconductive section 2A constituted by ion-exchanged water; a configuration wherein nitrile rubber is provided on the surface of an electroconductive section 2A constituted by ion-exchanged water, and a woven fabric-made surface section 3 is formed on the surface of the rubber; a configuration wherein nitrile rubber is provided on the surface of an electroconductive section 2A constituted by ion-exchanged water, and a nonwoven fabric-made surface section 3 is formed on the surface of the rubber; and a configuration wherein nitrile rubber is provided on the surface of an electroconductive section 2A constituted by ion-exchanged water, and a paper-made surface section 3 is formed on the surface of the rubber.

The size of the electroconductive section 2A constituting the fiber collection tool 1 can be varied as appropriate depending on, for example, the material forming the electroconductive section 2A or the use of the film F formed by electrospinning. From the viewpoint of sufficiently securing electroconductivity of the fiber collection tool 1 during electrospinning and thereby further improving fiber spinnability, it is preferable that the volume of the electroconductive section 2A is preferably 200 $cm^3$ or greater, more preferably 300 $cm^3$ or greater, and preferably 2000 $cm^3$ or less, more preferably 1000 $cm^3$ or less.

In cases where the fiber collection tool 1 has a surface section 3, from the viewpoint of sufficiently securing electroconductivity of the fiber collection tool 1 during electrospinning and thereby further improving fiber spinnability, it is preferable that the thickness T1 of the surface section 3 is preferably 10 μm or greater, more preferably 50 μm or greater, and preferably $10^4$ μm or less, more preferably 1000 μm or less. The thickness of the surface section 3 can be measured, for example, by using digital vernier calipers (QuantuMike from Mitutoyo Corporation) under no load. The thickness T1 of the surface section 3 may be the same at any discretionary position of the surface section 3, or may be different among various surface sections 3 within the aforementioned range of thickness.

In cases where at least one of the electroconductive section 2A or the surface section 3 constituting the fiber collection tool 1 includes a porous material, the structure of the porous material, such as the pores etc., may be as described in the explanation on the fiber collection tool having the aforementioned configuration (1).

The fiber collection tool 1 having the aforementioned configuration has a size that is holdable by the user's hand, and is thus easy to carry or take along. Also, the burden of gripping the tool during fiber spinning by electrospinning is reduced, thereby improving spinnability and spinning convenience. Further, the fiber collection tool 1 preferably has a surface electrical resistivity and/or volume electrical resistivity being equal to or less than a predetermined value. This facilitates the formation of an electric field between an electrospinning device and the fiber collection tool 1, thereby offering excellent fiber spinnability by electrospinning. Furthermore, the user himself/herself can produce a desired film, and also, there is less limitation in terms of the areas where the film can be attached.

In addition, the fiber collection tool 1 has excellent transferring properties for transferring the fiber deposit F, which is formed on the surface of the fiber collection tool, onto a transfer-target object such as the skin. The reason why the tool has excellent transferring properties is thought to be attributable to the fiber collection tool 1 having a hydrophilic section, which has high electroconductivity, on the surface thereof, which improves fiber spinnability. Improved spinnability in the fiber collection tool 1 enables concentrated deposition of fibers spun onto the collection surface of the fiber collection tool 1, thus enabling a fiber deposit F to be formed favorably. The fiber deposit F can be peeled easily from the fiber collection tool 1, thus enabling the fiber deposit F to be transferred efficiently onto the skin etc. That is, the operation for transferring the fiber deposit F is facilitated. In cases where the fiber collection tool 1 has elasticity, the shape of the fiber collection tool 1 can be deformed easily by application of gripping force. That is, the shape of the fiber collection surface can be changed easily. As a result, spinning can be performed so that the range for forming the fiber deposit F and the planar shape thereof can take on a desired range and shape depending on the shape of the transfer-target object, and also, the fiber deposit F can be peeled off from the collection surface easily, thereby enabling smooth transferring operation.

Next, with reference to FIGS. 3 and 4, a method for producing a deposit F of fiber spun by electrospinning, and preferably a film constituted by the fiber deposit, will be described.

In the present production method, a fiber deposit F is produced by collecting, on a surface of a fiber collection tool 1, a fiber spun by a user A by performing electrospinning using an electrospinning device 10. The thus-produced fiber deposit F is preferably a film including the fiber deposit, more preferably a film consisting of the fiber deposit, and is preferably a porous film.

In the present production method, it is preferable that at least the fiber collection tool 1 has a size holdable by the user A's hand, and more preferably, both the fiber collection tool 1 and the electrospinning device 10 have a size holdable by the user A's hand. Thus, the tool/device is easy to carry or take along, and also, the burden of gripping during fiber spinning by electrospinning is reduced, thereby further improving spinning convenience. Furthermore, the user himself/herself can produce a desired film, and also, there is less restriction in terms of the areas where the film can be attached.

In the production method of the present invention, a film including a fiber deposit is produced on a surface of an object. More specifically, a film including a fiber deposit is produced on a surface of an object by transferring the formed film onto the surface of the object.

From the viewpoint of easily forming the film, it is preferable that the film constituted by the fiber deposit is formed by depositing fiber spun by electrospinning, and more preferably, formed by depositing the fiber on a surface of a fiber collection tool 1.

Figure 3:
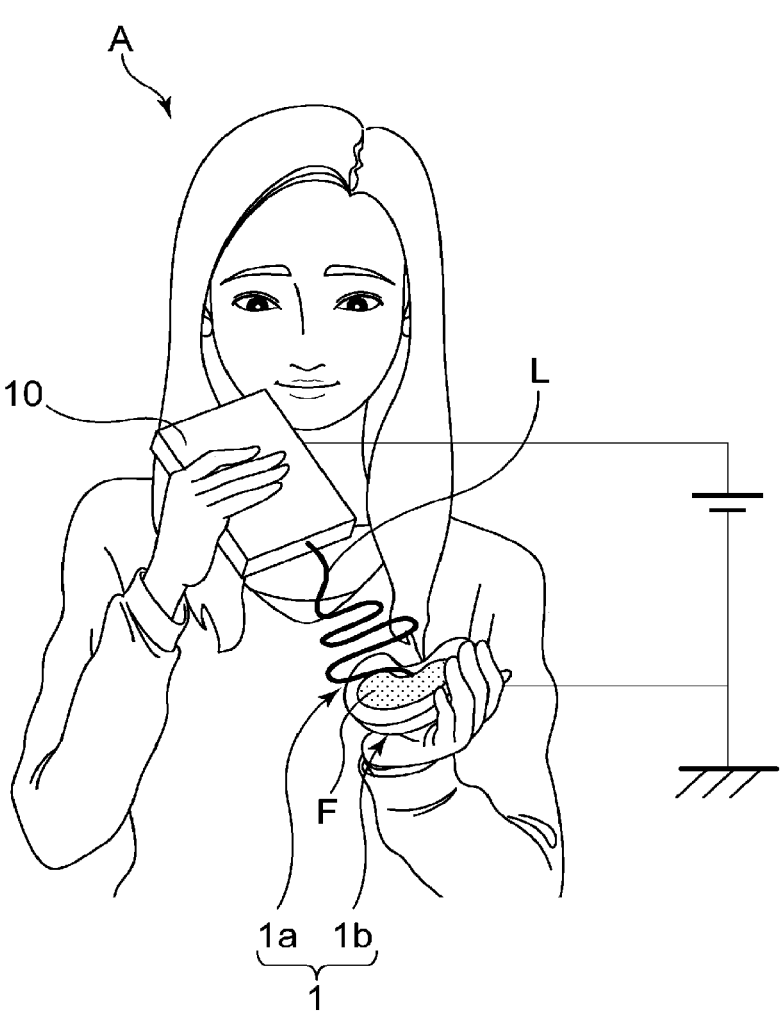
FIG. 3 is a schematic diagram illustrating an embodiment of a production method according to the present invention.

FIG. 3 illustrates an embodiment of a method for forming a film F on a surface of a fiber collection tool 1 by electrospinning.

As illustrated in the figure, in the present method, a fiber spun by a user A by performing electrospinning using an electrospinning device 10 is collected with a fiber collection tool 1, and a film F including a deposit of the fiber is formed on a surface of the fiber collection tool 1.

More specifically, the user A holds the electrospinning device 10 with one hand and holds the fiber collection tool 1 with the other hand, and the user A himself/herself collects the fiber and produces the fiber deposit F.

In further detail, the figure illustrates an embodiment wherein, in a state where the user A, who is the producer of the fiber deposit F (film F), holds the electrospinning device 10 with one hand and keeping a portion of the body, such as the other hand, in contact with a portion of the second principal surface 1*b* of the fiber collection tool 1, the user A himself/herself collects the fiber and produces the fiber deposit F.

When producing the fiber deposit F, a power source (not illustrated) of the electrospinning device 10 is turned on in a state where a nozzle (not illustrated) of the electrospinning device 10, through which a material liquid L of the fiber is ejected, is facing the first principal surface 1*a* serving as the collection surface of the fiber collection tool 1. In this way, the material liquid is ejected from the nozzle in a state where the nozzle is applied with a positive or negative voltage, and thereby electrospinning is performed. In the embodiment illustrated in FIG. 3, electrospinning is performed in a state where a positive voltage is applied to the nozzle.

More specifically, when the power of the electrospinning device 10 is turned on, an electrical conduction path is formed between the nozzle of the electrospinning device 10 and the fiber collection tool 1, wherein the voltage of the nozzle is either positive or negative and the fiber collection tool 1 and the user's body in contact therewith are grounded. That is, an electrical conduction path—i.e., an electric circuit—passing through the user A's body is formed between the nozzle of the electrospinning device 10 and the fiber collection tool 1. In the production method illustrated in FIG. 3, electrospinning is performed in a state where this electrical conduction path is formed.

When the material liquid L is ejected from the electrospinning device 10 in this state, the electric field created between the nozzle and the fiber collection tool 1 causes the material liquid L, which is ejected into the electric field from the tip end of the nozzle, to polarize by electrostatic induction and thereby form a cone shape at the tip-end portion thereof. From the tip end of this cone, liquid droplets of the charged material liquid L are ejected into the air toward the fiber collection tool 1 along the electric field. The ejected material liquid L is repeatedly drawn by electric attraction and self-repellant force by the material liquid's own charge, and is thereby made into an ultrathin fiber, which reaches the first principal surface 1*a* serving as the collection surface. In this way, a fiber deposit F is formed on the collection surface. As illustrated in FIG. 2, in cases where the fiber collection tool 1 has a surface section 3, the fiber deposit F is formed on the outermost surface of the surface section 3.

Particularly, by using a fiber collection tool 1 provided with an electroconductive section having the aforementioned surface electrical resistivity, or by using a fiber collection tool provided with a hydrophilic section having the aforementioned water contact angle, or by using a fiber collection tool having the aforementioned volume electrical resistivity, or by using a fiber collection tool having a surface section 3 formed on the surface of the electroconductive section 2A (see FIG. 2), the charged material liquid can easily be formed into a fiber and be deposited onto the collection surface, thus further improving fiber spinnability.

Figure 4:
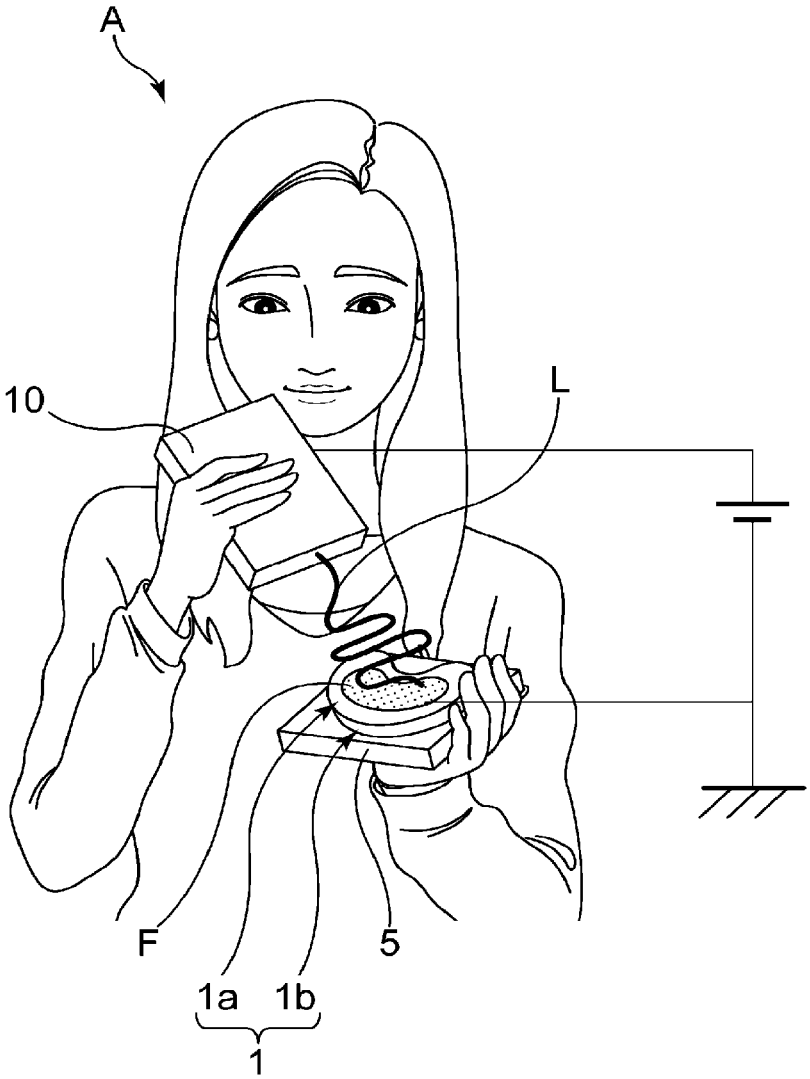
FIG. 4 is a schematic diagram illustrating another embodiment of a production method according to the present invention.

FIG. 4 illustrates another method for producing a film including a fiber deposit. In the embodiment illustrated in FIG. 4, the fiber collection tool 1 is placed on an electric conductor 5 such that a portion of the second principal surface 1*b* of the fiber collection tool 1 is in contact with a portion of the electric conductor 5. In this state, the user A performs electrospinning by holding the electrospinning device 10 with one hand and keeping a portion of the body, such as the other hand, in contact with a portion of the electric conductor 5 other than the portion in contact with the fiber collection tool. By performing electrospinning in this state, an electrical conduction path is formed, wherein the voltage of the nozzle is either positive or negative and the fiber collection tool 1, the electric conductor 5 and the user's body in contact therewith are grounded. The embodiment illustrated in FIG. 4 is in a state where a positive voltage is applied to the nozzle. As a result, as in the embodiment illustrated in FIG. 3, a fiber deposit F is formed on the first principal surface 1*a* serving as the collection surface. In this production method, by having the electric conductor 5 in contact, the electroconductivity of the fiber collection tool 1 can be further increased, thus further improving fiber spinnability.

The electric conductor 5 may be made from, for example, an electroconductive material such as metal etc. The planar-view shape of the electric conductor 5 is not particularly limited, so long as it has a surface on which the fiber collection tool 1 can be placed. Examples of the planar-view shape of the electric conductor 5 may include triangular, quadrangular, circular, elliptic, etc. The electric conductor 5 illustrated in FIG. 4 is a plate-like article having a rectangular planar-view shape. Like the fiber collection tool 1 and the electrospinning device 10, it is preferable that the electric conductor 5 has a size holdable by the user's hand.

In either of the aforementioned production methods, it is preferable that the fiber collection tool 1 to be used has one of the aforementioned configurations (1) to (3). That is, a fiber collection tool 1 having at least one of the aforementioned structures can preferably be used.

Further, it is preferable that the fiber collection tool 1 to be used in the aforementioned production methods includes a porous material, and more preferably includes a porous and elastic material.

In the example of configuration (1), it is preferable that the fiber collection tool includes, in at least a portion of the surface thereof, an electroconductive section having a surface electrical resistivity of $10^{11}$ Ω/cm$^2$ or less, and more preferably, the surface electrical resistivity at any discretionary position of the fiber collection tool 1 is $10^{11}$ Ω/cm$^2$ or less.

Further, in the example of configuration (2), it is preferable that, in either of the aforementioned production methods, the fiber collection tool 1 to be used includes a hydrophilic section in at least a portion of the surface thereof. Preferably, the hydrophilic section has a water contact angle of from 15° to 90° at 25° C. Further, preferably, the water absorption time of the hydrophilic section when 0.1 mL of water is dropped at 25° C. is 4 hours or less. More preferably, the fiber collection tool 1 has a water contact angle at 25° C. of from 18° to 90° at any discretionary position. Further, more preferably, the water absorption time of the fiber collection tool 1 when 0.1 mL of water is dropped at 25° C. is 4 hours or less at any discretionary position. The fiber collection tool 1 to be used in the aforementioned production methods preferably has elasticity along a direction in which the fiber is collected and deposited, and preferably includes a porous material. Further, in the fiber collection tool 1 to be used in the aforementioned production methods, it is preferable that a surfactant is present in the hydrophilic section.

The electrospinning device 10 includes: a containing portion for containing a material liquid serving as a material for the fiber; an electroconductive nozzle for ejecting the material liquid; a power source for applying a voltage to the nozzle; and a housing for housing these elements therein. Any of various known types of devices may be used for the electrospinning device 10 having the aforementioned configuration, with usable examples including the electrostatic spraying device disclosed in JP 2017-078062A, the electrostatic spraying device disclosed in JP 2018-100301A, and the electrostatic spraying device disclosed in JP 2019-38856A.

According to the aforementioned method for producing a fiber deposit F (film F), the user A himself/herself operates the electrospinning device 10, and thus, it is possible to produce a film F having a shape and size as desired by the user A. Further, the film F is formed on the surface of the fiber collection tool 1, and thus, compared to methods wherein the film F is directly formed on the surface of a target object, it is possible to reliably transfer a desired film F onto the surface of an object and also transfer the film F even onto such parts as the eyes, nose, ears, neck, hair, etc., where it is difficult to perform electrospinning directly.

From the viewpoint of further improving handleability by the user A himself/herself at the time of forming a film F, it is preferable that one or both of the electrospinning device 10 and the fiber collection tool 1 have/has a size holdable by the user A's hand. In the method illustrated in FIG. 3, both the electrospinning device 10 and the fiber collection tool 1 have a size holdable by the user A's hand. Instead, either one of the electrospinning device 10 or the fiber collection tool 1 may have a size holdable by the user A's hand and the other may have a size that is not holdable by the user A's hand. For example, the electrospinning device may be a large stationary-type device.

The material liquid used for electrospinning is a solution or a melt containing a polymer. The polymer used herein may have fiber formability, and concrete examples thereof may include water-soluble polymers and water-insoluble polymers. Herein, "water-soluble polymer" refers to a polymer having a property wherein, in an environment of 1 atm. and 23° C., when 1 g of the polymer is immersed in 10 g of ion-exchanged water, at least 0.5 g of the immersed polymer dissolves in water after 24 hours. On the other hand, herein, "water-insoluble polymer" refers to a polymer having a property wherein, in an environment of 1 atm. and 23° C., when 1 g of the polymer is immersed in 10 g of ion-exchanged water, less than 0.5 g of the immersed polymer dissolves in water after 24 hours. From the viewpoint of easily achieving fiber formability, it is preferable that the material liquid used for electrospinning contains a water-insoluble polymer.

Examples of the water-soluble polymer having fiber formability may include one or more types selected from: natural polymers, e.g., pullulan, mucopolysaccharides such as hyaluronic acid, chondroitin sulfate, poly-γ-glutamic acid, modified corn starch, β-glucan, glucooligosaccharide, heparin and keratosulfate, cellulose, pectin, xylan, lignin, glucomannan, galacturonic acid, psyllium seed gum, tamarind seed gum, gum arabic, tragacanth gum, water-soluble soybean polysaccharides, alginic acid, carrageenan, laminaran, agar (agarose), fucoidan, methyl cellulose, hydroxypropyl cellulose, and hydroxypropyl methylcellulose; and synthetic polymers, e.g., partially saponified polyvinyl alcohol (not used in combination with a cross-linking agent), low-saponification polyvinyl alcohol, polyvinyl pyrrolidone (PVP), polyethylene oxide, and sodium polyacrylate.

Among these water-soluble polymers, from the viewpoint of easy producibility of fibers, it is preferable to use one or more types selected from pullulan and synthetic polymers, such as partially saponified polyvinyl alcohol, low-saponification polyvinyl alcohol, polyvinyl pyrrolidone, polyethylene oxide, etc.

In cases of using polyethylene oxide as the water-soluble polymer, it is even more preferable that the number-average molecular weight thereof is preferably from 50,000 to 3,000,000, more preferably from 100,000 to 2,500,000.

Examples of the water-insoluble polymer having fiber formability may include one or more types selected from: completely saponified polyvinyl alcohol that can be made insoluble after formation of fibers, partially saponified polyvinyl alcohol that can be cross-linked after formation of fibers when used in combination with a cross-linking agent, oxazoline-modified silicone such as poly(N-propanoylethyleneimine)-graft-dimethylsiloxane/γ-aminopropylmethylsiloxane copolymer, polyvinylacetal diethylaminoacetate, zein (primary component of corn protein), polyester resins such as polylactic acid (PLA), polyacrylonitrile resins, acrylic resins such as polymethacrylate resins, polystyrene resins, polyvinyl butyral resins, polyethylene terephthalate resins, polybutylene terephthalate resins, polyurethane resins, polyamide resins, polyimide resins, and polyamide imide resins.

Among these water-insoluble polymers, it is preferable to use one or more types selected from completely saponified polyvinyl alcohol that can be made insoluble after formation of a film constituted by a fiber deposit, partially saponified polyvinyl alcohol that can be cross-linked after formation of a film constituted by a fiber deposit when used in combination with a cross-linking agent, polyvinyl butyral resins, acrylic resins such as (alkyl acrylateoctylamide) copolymer etc., oxazoline-modified silicone such as poly(N-propanoylethyleneimine)-graft-dimethylsiloxane/γ-aminopropylmethylsiloxane copolymer, polyurethane resins, polyester resins such as polylactic acid, and zein.

In cases of using a solution containing the aforementioned polymer as the material liquid used for electrospinning, examples of solvents usable for the polymer solution may include one or more types selected from the group consisting of volatile substances such as alcohols, e.g., ethanol, isopropyl alcohol, butyl alcohol, etc., and water.

In this production method, from the viewpoint of successfully forming a fiber deposit in a predetermined position, the shortest distance between the tip end of the nozzle of the electrospinning device 10 and the collection surface of the fiber collection tool 1 may preferably be 30 mm or greater, more preferably 50 mm or greater, even more preferably 80 mm or greater, and preferably 180 mm or less, more preferably 150 mm or less.

From the viewpoint of further improving the transferring properties of the fiber deposit (film), it is preferable that a film F having a higher adhesiveness to the object than the adhesiveness to the fiber collection tool 1 is formed on the surface of the fiber collection tool. From the viewpoint of making the adhesiveness between the fiber deposit (film) and the object higher than the adhesiveness between the film F and the fiber collection tool 1, it is preferable to perform a treatment that reduces the adhesiveness between the film F and the fiber collection tool 1. Examples of such treatments may include coating or spraying the surface of the fiber collection tool 1 with the aforementioned agent having a releasing action, providing the surface of the fiber collection tool 1 with a projecting-and-depressed structure, coating the surface of the object with an adhesive, and the like.

The fiber deposit F produced through the aforementioned steps is preferably a porous film-like product constituted by a deposit of fiber. Such a fiber deposit F can be used by being attached or transferred onto the surface of an adhesion object. Examples of objects to which the deposit can be attached/transferred may include the skin, nails, teeth, gums or hair of a human being, the skin, teeth or gums of a non-human mammal, and the surface of a plant such as the branches or leaves, and may preferably be the skin or nails of a human being. Particularly, the fiber deposit obtained by the present invention can suitably be used for various aesthetic methods that are not intended for surgical, therapeutic or diagnostic methods for the human body. More specifically, the fiber deposit may be used for aesthetic purposes, such as whitening of the skin in the applied areas, concealing of spots on the skin, concealing of dullness/dark circles on the skin, concealing of wrinkles on the skin, blurring of the skin, protection of the skin from UV rays, moisturizing of the skin, and the like. Other than the above, the fiber deposit may be used for various actions conducted domestically and personally for the protection of the skin, such as protection of various wounds, e.g., abrasion, cuts, laceration, stab wounds, etc., prevention of bedsores, and the like.

In cases where electrospinning is employed to form a film F constituted by a fiber deposit, it is possible to obtain a film F whose thickness gradually decreases from the film's central section toward the film's outer edge. Also, the film F will be formed by electrospinning by the user A's operation. Stated differently, the film F will be formed in a shape and size as desired by the user A, and thus, there is no need for cutting.

Further, before being transferred onto the object, the film F formed on the surface of the fiber collection tool 1 may be subjected to such a process as vapor deposition, plating, printing, etc. In such cases, for example, the process is performed in a state where the film F is arranged on the surface of the fiber collection tool 1. In this way, the film F can be subjected to a process that would otherwise be difficult to apply directly onto an object such as the skin, and by transferring the processed film F onto the object, a finish can be obtained as if the process were directly applied to the object. More specifically, for example, a film F on the surface of the fiber collection tool 1 may be subjected to a printing process for printing a predetermined design/pattern, and by transferring the processed film F onto an object, a finish can be obtained as if the design/pattern were directly rendered on the object. The more elaborate the design/pattern is, the better the working efficiency, compared to methods of directly rendering the design/pattern onto the object.

For the printing process, it is possible to use a known printing method such as inkjet printing, etc., and it is also possible to use printing methods that are difficult to apply directly to an object. For example, a printing process involving vapor deposition, UV curing or heat treatment of an ink material is difficult to apply to the skin. However, by applying this printing process to the film F and then transferring the film onto the skin, a finish employing this printing process can be obtained.

Figure 5A:
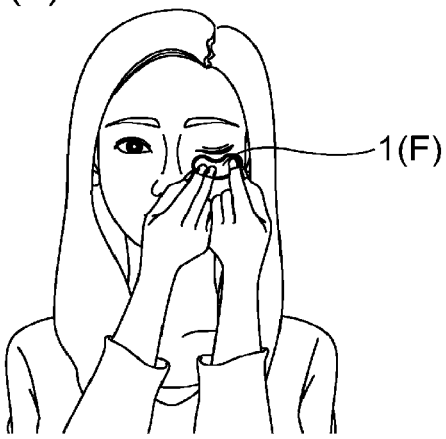
FIGS. 5(*a*) and 5(*b*) are schematic diagrams illustrating an embodiment of a method for attaching a deposit (film) of fiber according to the present invention.
Figure 5B:
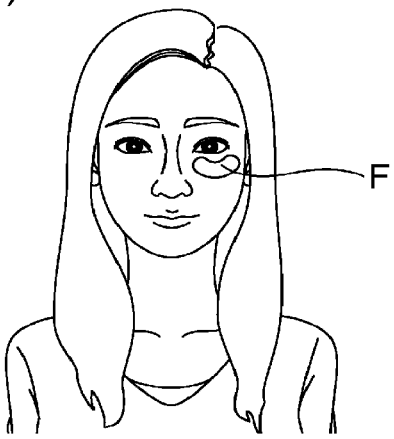

FIGS. 5(*a*) and 5(*b*) illustrate an embodiment wherein a film F including a fiber deposit formed on the surface of a fiber collection tool 1 is applied to the skin near a person's eye, serving as an object to which the film is attached/transferred. Stated differently, the present embodiment is an embodiment of a method for attaching a film.

In the present mode of use, as illustrated in FIG. 5(*a*), for example, a fiber deposit F formed on the surface of a fiber collection tool 1 by spinning performed by a user through electrospinning using an electrospinning device is brought in opposition to the surface of the skin, which is an adhesion object, and the fiber deposit F is then pressed against or otherwise brought into contact with the surface of the skin, serving as the adhesion object, and is attached thereto. Then, the fiber collection tool 1 is separated and removed from the adhesion object such that the fiber deposit F is peeled off from the surface of the fiber collection tool 1. In this way, as illustrated in FIG. 5(*b*), only the fiber deposit F adheres to the surface of the adhesion object. That is, the film F is transferred onto the surface of the object.

Particularly, from the viewpoint of improving the tight-adhesiveness between the fiber deposit F and the surface of the adhesion object and also improving the appearance of the area where the fiber deposit has been attached, it is preferable to attach the fiber deposit F in a moistened state onto the surface of the adhesion object. Examples of methods therefor may include: (i) a method of making the fiber deposit F adhere to the object's surface in a state where the object's surface is moistened; (ii) a method of moistening the fiber deposit F after making the fiber deposit F adhere to the object's surface; and (iii) a method of making the fiber deposit F adhere to the object's surface in a state where the fiber deposit F is moistened. To bring the fiber deposit F in a moistened state, the fiber deposit F and/or the surface of the adhesion object may, for example, be coated or sprayed with a liquid substance that is different from the polymer-containing solution or melt and that contains at least one type of liquid selected from various types of water, polyols that are liquid at 20° C., and oils that are either liquid or solid at 20° C.

In cases where the aforementioned liquid substance contains water, examples of the liquid substance may be a liquid, such as water, an aqueous solution, an aqueous dispersion, etc., a gel-like substance thickened with a thickener, an oil that is either liquid or solid at 20° C., an oily agent containing 10 mass % or greater of the aforementioned oil, an emulsion (O/W emulsion or W/O emulsion) containing the aforementioned oil and a surfactant such as a nonionic surfactant, or the like.

In cases where the aforementioned liquid substance contains a polyol that is liquid at 20° C., examples of the polyol may include one or more types selected from ethylene glycol, propylene glycol, 1,3-butane diol, dipropylene glycol, polyethylene glycol having a weight-average molecular weight of 2000 or less, glycerin, and diglycerin.

In cases where the aforementioned liquid substance contains an oil that is liquid at 20° C., examples of the oil may include: one or more types of hydrocarbon oils selected from liquid paraffin, squalane, squalene, n-octane, n-heptane, cyclohexane, light isoparaffin and liquid isoparaffin; one or more types of ester oils selected from esters of linear or branched fatty acids and linear or branched alcohols or polyols, such as octyldodecyl myristate, myristyl myristate, isocetyl stearate, isocetyl isostearate, cetearyl isononanoate, diisobutyl adipate, di-2-ethylhexyl sebacate, isopropyl myristate, isopropyl palmitate, diisostearyl malate, neopentyl glycol dicaprate and alkyl (C12-15) benzoate, and triglycerol fatty acid esters (triglycerides) such as caprylic/capric triglyceride; and one or more types of silicone oils selected from dimethyl polysiloxane, dimethyl cyclopolysiloxane, methylphenyl polysiloxane, methylhydrogen polysiloxane and higher alcohol-modified organopolysiloxane. The aforementioned oil may be used singly, or two or more types may be used in combination.

In cases where the aforementioned liquid substance contains a fat that is solid at 20° C., examples of the fat may include one or more types selected from vaseline, cetanol, stearyl alcohol, and ceramide.

From the viewpoint of further improving transferring properties, it is preferable to apply in advance, to the surface of the object, an agent for increasing adhesiveness between the object and the film F, and in this state, press the fiber collection tool 1, having the film F formed thereon, against the surface of the object. The term "transferring properties" refers to properties of pressing the film F against an object and causing the film F to adhere to the object. The agent for increasing adhesiveness is applied to the object by being coated or sprayed onto the surface of the object.

For the agent for increasing adhesiveness, any agent capable of increasing the adhesiveness between an object and the film F can be used without particular limitation, with examples including liquid cosmetics such as toners, moisturizers, creams, gels, serums, etc.

The present invention has been described above according to preferred embodiments thereof, but the present invention is not limited to the foregoing embodiments. For example, in the embodiment illustrated in FIG. 3, the user holds both the fiber collection tool 1 and the electrospinning device 10 and creates an electric field between the fiber collection tool 1 and the nozzle of the electrospinning device 10. However, the user himself/herself does not necessarily have to hold both the fiber collection tool 1 and the electrospinning device 10, so long as an electric field can be created therebetween. Further, in the embodiments illustrated in FIGS. 3 and 4, the electrospinning device 10 has a size holdable with the hand, but instead, the electrospinning device may be a large stationary-type device.

Further, in the embodiments illustrated in FIGS. 3 and 4, the fiber is deposited directly on the collection surface of the fiber collection tool 1, but so long as the effects of the present invention can be achieved, for example, a fiber sheet such as a nonwoven fabric may be further arranged on the collection surface and spinning of fiber may be performed in this state, to form a film including the fiber deposit on the fiber sheet.

Further, in the embodiment illustrated in FIG. 4, electrospinning is performed with the fiber collection tool 1 and the electric conductor 5 in contact with one another, but instead, electrospinning may be performed by using a fiber collection tool 1 in which at least a surface of the material forming the tool is subjected to a treatment for increasing electroconductivity. Examples of treatments for increasing electroconductivity may include mixing or coating of the material forming the fiber collection tool 1 with an electroconductive material such as copper, carbon, etc.

Further, the embodiments illustrated in FIGS. 3 and 4 describe examples wherein electrospinning is performed with the fiber collection tool 1 being directly held with the hand or the fiber collection tool 1 being held with the hand via the electric conductor 5. However, so long as the effects of the present invention can be achieved, electrospinning may be performed in a state where the fiber collection tool 1 is in contact, either directly or via the electric conductor 5, with a portion of the user's body other than the hand. Examples of body parts other than the user's hand may include the arm, leg, elbow, knee, etc., although not limited thereto.

In relation to the foregoing embodiments, the present invention further discloses the following fiber collection tools, fiber deposit production methods using the same, film production methods, and film attachment methods.

{1}

A fiber collection tool to be used for collecting a fiber spun by electrospinning, wherein:

the fiber collection tool has a size holdable by a user's hand, and includes, in at least a portion of the surface thereof, an electroconductive section having a surface electrical resistivity of $10^{11}$ Ω/cm$^2$ or less.

{2}

The fiber collection tool as set forth in clause {1}, wherein the fiber collection surface and a section to contact the user's body each have the electroconductive section.

{3}

The fiber collection tool as set forth in clause {1} or {2}, wherein the electroconductive section of the fiber collection surface and the electroconductive section of the section to contact the user's body are formed continuously.

{4}

The fiber collection tool as set forth in any one of clauses {1} to {3}, wherein the electroconductive section is formed continuously over the entire region of the surface of the fiber collection tool.

{5}

The fiber collection tool as set forth in any one of clauses {1} to {4}, wherein the collection tool has a surface electrical resistivity of $10^{11}$ Ω/cm$^2$ or less at a discretionary position on the surface thereof.

{6}

The fiber collection tool as set forth in any one of clauses {1} to {3}, wherein the electroconductive section is formed in only a portion of the surface of the fiber collection tool.

{7}

The fiber collection tool as set forth in clause {6}, wherein the electroconductive section is formed continuously.

{8}

The fiber collection tool as set forth in clause {6} or {7}, wherein the electroconductive section is formed so as to extend to a region, or vicinity thereof, that can be touched by a portion of the user's body.

{9}

The fiber collection tool as set forth in any one of clauses {1} to {8}, wherein the electroconductive section of the fiber collection tool has a surface electrical resistivity of preferably $10^{11}$ Ω/cm$^2$ or less, more preferably $8.0\times10^{10}$ Ω/cm$^2$ or less, even more preferably $5.0\times10^{10}$ Ω/cm$^2$ or less, even more preferably $10^{10}$ Ω/cm$^2$ or less.

{10}

The fiber collection tool as set forth in any one of clauses {1} to {9}, wherein the fiber collection tool includes at least one type of constituent material selected from fiber sheets, films, porous bodies, and elastic bodies.

{11}

The fiber collection tool as set forth in clause {10}, wherein:

the fiber collection tool includes a fiber sheet as the constituent material; and the fiber sheet is at least one type selected from various nonwoven fabrics, woven fabrics, knitted fabrics, paper, mesh sheets, and laminates thereof.

{12}

The fiber collection tool as set forth in clause {10} or {11}, wherein:

the fiber collection tool includes a film as the constituent material; and the film includes at least one type selected from mesh films including, as a material thereof, at least one type selected polyethylene resins and polypropylene resins, and various film sheets.

{13}

The fiber collection tool as set forth in any one of clauses {10} to {12}, wherein:

the fiber collection tool includes a porous body as the constituent material; and the porous body is a foam including at least one type selected from polyurethane, wet urethane, acrylonitrile-butadiene copolymer (NBR), styrene butadiene copolymer (SBR), natural rubber (NR), ethylene-propylene-diene copolymer (EPDM), melamine foam, polyvinyl alcohol (PVA), and cellulose.

{14}

The fiber collection tool as set forth in any one of clauses {10} to {13}, wherein:

the fiber collection tool includes an elastic body as the constituent material;

the elastic body is a rubber product or an elastomer product including at least one type selected from rubber-made meshes, various rubber sheets, and foamed rubber (rubber sponge); and the product includes at least one type selected from rubber-like substances such as natural rubber, synthetic rubber, silicone rubber, acrylic rubber, urethane rubber, and nitrile rubber.

{15}

The fiber collection tool as set forth in any one of clauses {10} to {14}, wherein an electroconductive material is provided to at least a surface of the constituent material.

{16}

The fiber collection tool as set forth in any one of clauses {1} to {15}, wherein the fiber collection tool includes a porous material.

{17}

The fiber collection tool as set forth in clause {16}, wherein the fiber collection tool is a monolithic molded body of the porous material.

{18}

The fiber collection tool as set forth in clause {16}, wherein:

the fiber collection tool is constituted by including, in combination, a plurality of molded bodies of the porous material; and the electroconductive sections of the respective molded bodies are electrically connected.

{19}

The fiber collection tool as set forth in any one of clauses {16} to {18}, wherein the porous material is at least one type selected from fiber sheets, porous bodies, and fiber sheets/porous bodies containing an electroconductive material.

{20}

The fiber collection tool as set forth in any one of clauses {16} to {19}, wherein pores formed in the porous material are connected (open) pores, independent (closed) pores, or a combination thereof.

{21}

The fiber collection tool as set forth in any one of clauses {16} to {20}, wherein the pore diameter of the porous material is preferably 10 μm or greater, more preferably 20 μm or greater, and preferably 1000 μm or less, more preferably 900 μm or less.

{22}

The fiber collection tool as set forth in any one of clauses {16} to {21}, wherein the apparent density of the porous material is preferably 0.001 $g/cm^3$ or greater, more preferably 0.005 $g/cm^3$ or greater, and preferably 10 $g/cm^3$ or less, more preferably 5 $g/cm^3$ or less.

{23}

The fiber collection tool as set forth in any one of clauses {1} to {22}, wherein the fiber collection tool includes an elastic material.

{24}

The fiber collection tool as set forth in any one of clauses {1} to {23}, wherein the fiber collection tool is a monolithic molded body including an elastic material.

{25}

The fiber collection tool as set forth in clause {23} or {24}, wherein the hardness of the material, as measured with a rubber hardness meter, is preferably 1 or greater, more preferably 5 or greater, and preferably 95 or less, more preferably 90 or less.

{26}

The fiber collection tool as set forth in any one of clauses {23} to {25}, wherein the material is at least one type selected from foams such as polyurethane, wet urethane, acrylonitrile-butadiene copolymer (NBR) and melamine foam, and the aforementioned foams containing an electroconductive material.

{27}

The fiber collection tool as set forth in any one of clauses {1} to {26}, wherein:

the mass of the fiber collection tool is preferably 500 g or less, more preferably 200 g or less;

the maximum length spanning the fiber collection tool is preferably from 0.1 mm to 30 cm; and the volume of the fiber collection tool is preferably from 0.5 $cm^3$ to $10^4$ $cm^3$.

{28}

The fiber collection tool as set forth in any one of clauses {1} to {27}, wherein the fiber collection tool includes a hydrophilic section in at least a portion of the surface thereof.

{29}

A fiber collection tool to be used for collecting a fiber spun by electrospinning, wherein:

the fiber collection tool has a size holdable by a user's hand, and includes a hydrophilic section in at least a portion of the surface thereof; and the fiber collection tool has elasticity along a direction in which the fiber is collected and deposited.

{30}

The fiber collection tool as set forth in clause {28} or {29}, wherein the hydrophilic section has a water contact angle of from 15° to 90°, preferably from 18° to 90°, at 25° C.

{31}

The fiber collection tool as set forth in any one of clauses {28} to {30}, wherein a water absorption time of the hydrophilic section when 0.1 mL of water is dropped at 25° C. is from 0 seconds to 4 hours, preferably from 0 seconds to 3.5 hours, more preferably from 0 seconds to 2.25 hours.

{32}

The fiber collection tool as set forth in any one of clauses {28} to {31}, wherein the fiber collection tool includes a porous material.

{33}

The fiber collection tool as set forth in clause {32}, wherein the fiber collection tool is a monolithic molded body of the porous material.

{34}

The fiber collection tool as set forth in clause {32} or {33}, wherein the porous material includes at least one type of foam selected from polyurethane, wet urethane, acrylonitrilebutadiene copolymer (NBR), styrenebutadiene copolymer (SBR), natural rubber (NR), ethylenepropylenediene copolymer (EPDM), melamine foam, polyvinyl alcohol (PVA), and cellulose.

{35}

The fiber collection tool as set forth in clause {34}, wherein the foam is subjected to a hydrophilizing treatment.

{36}

The fiber collection tool as set forth in any one of clauses {32} to {35}, wherein pores formed in the porous material are connected (open) pores, independent (closed) pores, or a combination thereof.

{37}

The fiber collection tool as set forth in any one of clauses {32} to {36}, wherein the pore diameter of the porous material is preferably 10 μm or greater, more preferably 20 μm or greater, and preferably 1000 μm or less, more preferably 900 μm or less.

{38}

The fiber collection tool as set forth in any one of clauses {32} to {37}, wherein the apparent density of the porous material is preferably 0.001 g/cm$^3$ or greater, more preferably 0.005 g/cm$^3$ or greater, and preferably 10 g/cm$^3$ or less, more preferably 5 g/cm$^3$ or less.

{39}

The fiber collection tool as set forth in any one of clauses {28} to {38}, wherein a surfactant is present.

{40}

The fiber collection tool as set forth in clause {39}, wherein the surfactant is one or more types selected from cationic surfactants, anionic surfactants, amphoteric surfactants, and nonionic surfactants.

{41}

The fiber collection tool as set forth in clause {39} or {40}, wherein the content of the surfactant is 0.01 mass % or greater, preferably 0.05 mass % or greater, and 35 mass % or less, preferably 30 mass % or less, and from 0.01 to 35 mass %, preferably from 0.05 to 30 mass %.

{42}

The fiber collection tool as set forth in any one of clauses {28} to {41}, wherein:

the mass of the fiber collection tool is 500 g or less, and preferably 200 g or less; and the maximum length spanning the fiber collection tool is from 0.1 mm to 30 cm.

{43}

A method for producing a fiber deposit, comprising:

collecting a fiber with a fiber collection tool, the fiber being spun by a user by performing electrospinning using an electrospinning device; and producing a deposit of the fiber on a surface of the fiber collection tool, wherein:

the fiber collection tool includes, in at least a portion of the surface thereof, an electroconductive section having a surface electrical resistivity of $10^{11}$ Ω/cm$^2$ or less; and the method comprises collecting the fiber in the electroconductive section in a state where a portion of the user's body is in contact with a portion of the electroconductive section, or in a state where a portion of an electric conductor is in contact with the electroconductive section and a portion of the user's body is in contact with another portion of the electric conductor.

{44}

The method for producing a fiber deposit as set forth in clause {43}, wherein the fiber is collected in the electroconductive section in a state where the user holds the electrospinning device with one hand, and the other hand is in contact with the electroconductive section of the fiber collection tool.

{45}

The method for producing a fiber deposit as set forth in clause {43}, wherein the fiber is collected in the electroconductive section in a state where the user holds the electrospinning device with one hand, and the other hand is in contact with the electric conductor and the electric conductor is in contact with the electroconductive section of the fiber collection tool.

{46}

The method for producing a fiber deposit as set forth in any one of clauses {43} to {45}, wherein the collection tool has a surface electrical resistivity of $10^{11}$ Ω/cm$^2$ or less at a discretionary position on the surface thereof.

{47}

The method for producing a fiber deposit as set forth in any one of clauses {43} to {46}, wherein the collection tool includes a porous material.

{48}

The method for producing a fiber deposit as set forth in any one of clauses {43} to {47}, wherein the collection tool has elasticity.

{49}

The method for producing a fiber deposit as set forth in any one of clauses {43} to {48}, wherein:

the electrospinning is performed by using a material liquid serving as a material for the fiber; and the material liquid is a solution or a melt containing a polymer having fiber formability.

{50}

The method for producing a fiber deposit as set forth in clause {49}, wherein:

the polymer having fiber formability includes a water-soluble polymer; and the water-soluble polymer is preferably one or more types selected from: natural polymers, including pullulan, mucopolysaccharides such as hyaluronic acid, chondroitin sulfate, poly-γ-glutamic acid, modified corn starch, β-glucan, glucooligosaccharide, heparin and keratosulfate, cellulose, pectin, xylan, lignin, glucomannan, galacturonic acid, psyllium seed gum, tamarind seed gum, gum arabic, tragacanth gum, water-soluble soybean polysaccharides, alginic acid, carrageenan, laminaran, agar (agarose), fucoidan, methyl cellulose, hydroxypropyl cellulose, and hydroxypropyl methylcellulose; and synthetic polymers, including partially saponified polyvinyl alcohol (not used in combination with a cross-linking agent), low-saponification polyvinyl alcohol, polyvinyl pyrrolidone (PVP), polyethylene oxide, and sodium polyacrylate.

{51}

The method for producing a fiber deposit as set forth in clause {49}, wherein: the polymer having fiber formability includes a water-insoluble polymer; and the water-insoluble polymer is preferably one or more types selected from completely saponified polyvinyl alcohol that can be made insoluble after formation of fibers, partially saponified polyvinyl alcohol that can be cross-linked after formation of fibers when used in combination with a cross-linking agent, oxazoline-modified silicone such as poly(N-propanoylethyleneimine)-graft-dimethylsiloxane/γ-aminopropylmethylsiloxane copolymer, polyvinylacetal diethylaminoacetate, zein (primary component of corn protein), polyester resins such as polylactic acid (PLA), polyacrylonitrile resins, acrylic resins such as polymethacrylate resins, polystyrene resins, polyvinyl butyral resins, polyethylene terephthalate resins, polybutylene terephthalate resins, polyurethane resins, polyamide resins, polyimide resins, and polyamide imide resins.

{52}

The method for producing a fiber deposit as set forth in clause {51}, wherein the water-insoluble polymer is one or more types selected from completely saponified polyvinyl alcohol that can be made insoluble after formation of a film constituted by a fiber deposit, partially saponified polyvinyl alcohol that can be cross-linked after formation of a film constituted by a fiber deposit when used in combination with a cross-linking agent, polyvinyl butyral resins, acrylic resins such as (alkyl acrylate-octyl amide) copolymer, oxazoline-modified silicone such as poly(N-propanoylethyleneimine)-graft-dimethylsiloxane/γ-aminopropylmethylsiloxane copolymer, polyurethane resins, polyester resins such as polylactic acid, and zein.

{53}

The method for producing a fiber deposit as set forth in any one of clauses {49} to {52}, wherein:

a solution containing a polymer having fiber formability is used as the material liquid; and a solvent usable for the solution is one or more types selected from volatile substances such as alcohols, e.g., ethanol, isopropyl alcohol and butyl alcohol, and water.

{54}

The method for producing a fiber deposit as set forth in any one of clauses {43} to {53}, wherein:

the electrospinning device includes a containing portion for containing a material liquid serving as a material for the fiber, an electroconductive nozzle for ejecting the material liquid, a power source for applying a voltage to the nozzle, and a housing for housing these elements therein; and the shortest distance between the tip end of the nozzle and the collection surface of the fiber collection tool is preferably 30 mm or greater, more preferably 50 mm or greater, even more preferably 80 mm or greater, and preferably 180 mm or less, more preferably 150 mm or less.

{55}

The method for producing a fiber deposit as set forth in any one of clauses {43} to {54}, wherein the fiber collection tool includes a hydrophilic section in at least a portion of the surface thereof.

{56}

A method for producing a fiber deposit, comprising:

collecting a fiber with a fiber collection tool, the fiber being spun by a user by performing electrospinning using an electrospinning device; and producing a deposit of the fiber on a surface of the fiber collection tool, wherein:

the fiber collection tool includes a hydrophilic section in at least a portion of the surface thereof, and has elasticity along a direction in which the fiber is collected and deposited.

{57}

The method for producing a fiber deposit as set forth in clause {55} or {56}, wherein the hydrophilic section has a water contact angle of from 15° to 90° at 25° C.

{58}

The method for producing a fiber deposit as set forth in clause {55} or {56}, wherein the hydrophilic section has a water contact angle of from 18° to 90° at 25° C.

{59}

The method for producing a fiber deposit as set forth in clause {55} or {56}, wherein a water absorption time of the hydrophilic section when 0.1 mL of water is dropped at 25° C. is from 0 seconds to 4 hours.

{60}

The method for producing a fiber deposit as set forth in clause {55} or {56}, wherein the water absorption time of the hydrophilic section when 0.1 mL of water is dropped at 25° C. is from 0 seconds to 3.5 hours.

{61}

The method for producing a fiber deposit as set forth in clause {55} or {56}, wherein the water absorption time of the hydrophilic section when 0.1 mL of water is dropped at 25° C. is from 0 seconds to 2.25 hours.

{62}

The method for producing a fiber deposit as set forth in any one of clauses {55} to {61}, wherein a material forming the fiber collection tool is subjected to a hydrophilizing treatment.

{63}

The method for producing a fiber deposit as set forth in clause {62}, wherein the hydrophilizing treatment is a treatment of mixing, coating or immersion of the material forming the fiber collection tool with/in a hydrophilic base material or a surfactant.

{64}

The method for producing a fiber deposit as set forth in clause {63}, wherein the surfactant is one or more types selected from cationic surfactants, anionic surfactants, amphoteric surfactants, and nonionic surfactants.

{65}

The method for producing a fiber deposit as set forth in clause {63} or {64}, wherein the content of the surfactant in the fiber collection tool is 0.01 mass % or greater, preferably 0.05 mass % or greater, and 35 mass % or less, preferably 30 mass % or less, and from 0.01 to 35 mass %, preferably from 0.05 to 30 mass %.

{66}

The method for producing a fiber deposit as set forth in any one of clauses {55} to {65}, wherein electrospinning is performed in a state where the user holds the electrospinning device with one hand and holds the fiber collection tool with the other hand, and an electrical conduction path passing through the user's body is formed between the electrospinning device and the fiber collection tool.

{67}

The method for producing a fiber deposit as set forth in any one of clauses {55} to {66}, wherein electrospinning is performed in a state where the user holds the electrospinning device with one hand and hold is an electric conductor with the other hand with the electric conductor in contact with the fiber collection tool, and an electrical conduction path passing through the user's body and the electric conductor is formed between the electrospinning device and the fiber collection tool.

{68}

The method for producing a fiber deposit as set forth in any one of clauses {55} to {67}, wherein:

the electrospinning is performed by spinning the fiber using a material liquid serving as a material for the fiber; and the material liquid is a solution or a melt containing a polymer having fiber formability.

{69}

The method for producing a fiber deposit as set forth in clause {68}, wherein:

the polymer having fiber formability includes a water-soluble polymer; and the water-soluble polymer is one or more types selected from: natural polymers, including pullulan, mucopolysaccharides such as hyaluronic acid, chondroitin sulfate, poly-γ-glutamic acid, modified corn starch, β-glucan, glucooligosaccharide, heparin and keratosulfate, cellulose, pectin, xylan, lignin, glucomannan, galacturonic acid, *psyllium* seed gum, tamarind seed gum, gum arabic, tragacanth gum, water-soluble soybean polysaccharides, alginic acid, carrageenan, laminaran, agar (agarose), fucoidan, methyl cellulose, hydroxypropyl cellulose, and hydroxypropyl methylcellulose; and synthetic polymers, including partially saponified polyvinyl alcohol (not used in combination with a cross-linking agent), low-saponification polyvinyl alcohol, polyvinyl pyrrolidone (PVP), polyethylene oxide, and sodium polyacrylate.

{70}

The method for producing a fiber deposit as set forth in clause {68}, wherein:

the polymer having fiber formability includes a water-insoluble polymer; and the water-insoluble polymer is one or more types selected from completely saponified polyvinyl alcohol that can be made insoluble after formation of fibers, partially saponified polyvinyl alcohol that can be cross-linked after formation of fibers when used in combination with a cross-linking agent, oxazoline-modified silicone such as poly(N-propanoylethyleneimine)-graft-dimethylsiloxane/γ-aminopropylmethylsiloxane copolymer, polyvinylacetal diethylaminoacetate, zein (primary component of corn protein), polyester resins such as polylactic acid (PLA), polyacrylonitrile resins, acrylic resins such as polymethacrylate resins, polystyrene resins, polyvinyl butyral resins, polyethylene terephthalate resins, polybutylene terephthalate resins, polyurethane resins, polyamide resins, polyimide resins, and polyamide imide resins.

{71}

The method for producing a fiber deposit as set forth in clause {70}, wherein the water-insoluble polymer is one or more types selected from completely saponified polyvinyl alcohol that can be made insoluble after formation of a film constituted by a fiber deposit, partially saponified polyvinyl alcohol that can be cross-linked after formation of a film constituted by a fiber deposit when used in combination with a cross-linking agent, polyvinyl butyral resins, acrylic resins such as (alkyl acrylate octyl amide) copolymer, oxazoline-modified silicone such as poly(N-propanoylethyleneimine)-graft-dimethylsiloxane/γ-aminopropylmethylsiloxane copolymer, polyurethane resins, polyester resins such as polylactic acid, and zein.

{72}

The method for producing a fiber deposit as set forth in any one of clauses {68} to {71}, wherein:

the material liquid is a solution containing a polymer having fiber formability; and a solvent usable for the solution is one or more types selected from volatile substances such as alcohols, e.g., ethanol, isopropyl alcohol and butyl alcohol, and water.

{73}

The method for producing a fiber deposit as set forth in any one of clauses {55} to {72}, wherein:

the electrospinning device includes a containing portion for containing a material liquid serving as a material for the fiber, an electroconductive nozzle for ejecting the material liquid, a power source for applying a voltage to the nozzle, and a housing for housing these elements therein; and the shortest distance between the tip end of the nozzle and the collection surface of the fiber collection tool is 30 mm or greater, preferably 50 mm or greater, more preferably 80 mm or greater, and 180 mm or less, preferably 150 mm or less.

{74}

The method for producing a fiber deposit as set forth in any one of clauses {55} to {73}, wherein the fiber collection tool includes a porous material.

{75}

The method for producing a fiber deposit as set forth in any one of clauses {55} to {74}, wherein a surfactant is present in the fiber collection tool.

{76}

A method for producing, on a surface of an object, a film constituted by a fiber deposit, the method comprising:

by performing the method for producing a fiber deposit as set forth in any one of clauses {43} to {75}, forming a film including a fiber deposit on a surface of the aforementioned fiber collection tool, the forming being performed by a user; and pressing the fiber collection tool, having the film formed thereon, against a surface of an object and transferring the film onto the surface of the object, to form the film including the fiber deposit on the surface of the object.

{77}

A method for producing, on a surface of an object, a film constituted by a fiber deposit, the method comprising:

collecting, with a fiber collection tool, a fiber spun by a user by performing electrospinning using an electrospinning device, and forming a film including a deposit of the fiber on a surface of the fiber collection tool; and pressing the fiber collection tool, having the film formed thereon, against a surface of an object and transferring the film onto the surface of the object, to form the film including the fiber deposit on the surface of the object.

{78}

The method for producing a fiber deposit as set forth in clause {76} or {77}, wherein:

one or both of the electrospinning device and the fiber collection tool has/have a size holdable by the user's hand;

the user collects the fiber with the fiber collection tool, and forms the film including the fiber deposit on the surface of the fiber collection tool; and the user presses the fiber collection tool, having the film formed thereon, against the surface of the object.

{79}

The method for producing a fiber deposit as set forth in clause {76} or {77}, wherein:

the mass of the fiber collection tool is 500 g or less, preferably 200 g or less; and the maximum length spanning the fiber collection tool is from 0.1 mm to 30 cm.

{80}

The method for producing a fiber deposit as set forth in clause {76} or {77}, wherein:

the mass of the electrospinning device is 3000 g or less, preferably 2000 g or less; and the maximum length spanning the electrospinning device is 40 cm or less.

{81}

The method for producing a fiber deposit as set forth in any one of clauses {76} to {80}, wherein the fiber collection tool has, in the surface thereof, one or a plurality of depressions.

{82}

The method for producing a fiber deposit as set forth in clause {81}, wherein the depressions are through holes, penetrating grooves, or micropores in a porous body.

{83}

The method for producing a fiber deposit as set forth in clause {82}, wherein the porous body is a foam including, as a material, at least one type selected from polyurethane, wet urethane, acrylonitrile·butadiene copolymer (NBR), styrene·butadiene copolymer (SBR), natural rubber (NR), ethylene·propylene diene copolymer (EPDM), melamine foam, polyvinyl alcohol (PVA), and cellulose.

{84}

The method for producing a fiber deposit as set forth in any one of clauses {76} to {83}, wherein the fiber collection tool has, on the surface thereof, a section including napped fiber.

{85}

The method for producing a fiber deposit as set forth in clause {84}, wherein the napped section is a section in which short fibers are fixed on the surface in a standing state.

{86}

The method for producing a fiber deposit as set forth in any one of clauses {76} to {85}, wherein the fiber collection tool has, on the surface thereof, an agent having an action of releasing the film.

{87}

The method for producing a fiber deposit as set forth in clause {86}, wherein the agent having a releasing action is preferably a powdery agent, and more preferably is at least one type selected from silicic acid, silicic acid anhydride, magnesium silicate, talc, sericite, mica, kaoline, colcothar, clay, bentonite, mica, titanium-coated mica, bismuth oxychloride, zirconium oxide, magnesium oxide, titanium oxide, zinc oxide, aluminum oxide, calcium sulfate, barium sulfate, magnesium sulfate, calcium carbonate, magnesium carbonate, iron oxide, ultramarine blue, chromium oxide, chromium hydroxide, calamine, carbon black, boron nitride, polyamide, nylon, polyester, polypropylene, polystyrene, polyurethane, vinyl resins, urea resins, phenolic resins, fluorocarbon resins, silicon resins, acrylic resins, melamine resins, epoxy resins, polycarbonate resins, divinylbenzene styrene copolymer, silk powder, cellulose, metal salts of long-chain alkyl phosphates, N-mono-long-chain alkyl acyl basic amino acids, and composites of the above.

{88}

The method for producing a fiber deposit as set forth in any one of clauses {76} to {87}, comprising:

applying in advance, to the surface of the object, an agent for increasing adhesiveness between the object and the film, and in this state, pressing the fiber collection tool, having the film formed thereon, against the surface of the object.

{89}

The method for producing a fiber deposit as set forth in clause {88}, wherein the agent for increasing adhesiveness is at least one type of liquid cosmetic selected from toners, moisturizers, creams, gels, and serums.

{90}

The method for producing a fiber deposit as set forth in any one of clauses {76} to {89}, wherein the film formed on the surface of the fiber collection tool has a higher adhesiveness to the object than the adhesiveness to the fiber collection tool.

{91}

The method for producing a fiber deposit as set forth in any one of clauses {76} to {90}, wherein the thickness of the film gradually decreases from the film's central section toward the film's outer edge.

{92}

The method for producing a fiber deposit as set forth in any one of clauses {76} to {91}, wherein, before being transferred onto the object, the film formed on the surface of the fiber collection tool is subjected to at least one process selected from vapor deposition, plating, and printing.

{93}

The method for producing a fiber deposit as set forth in clause {92}, wherein the process is printing, and preferably inkjet printing.

{94}

A method for attaching a film, comprising:

collecting, with a fiber collection tool, a fiber spun by a user by performing electrospinning using an electrospinning device, and forming a film including a deposit of the fiber on a surface of the fiber collection tool; and pressing the fiber collection tool, having the film formed thereon, against a surface of an object and attaching the film onto the surface of the object.

EXAMPLES

The present invention will be described in further detail below according to Examples. Note, however, that the scope of the present invention is not limited to the following Examples.

Example 1-1

For the fiber collection tool 1, a cosmetic sponge (Natural Whip) from Inoac Corporation was used. This fiber collection tool was a molded body of a porous and elastic material, constituted by a NBR-made porous body being 52 mm long and 45 mm wide, and having rounded apexes and ridgelines, a pair of rectangular principal surfaces and 8-mm-thick side surfaces. The electroconductive section of the fiber collection tool 1 of the present Example was formed over the entire surface thereof, and the surface electrical resistivity of the electroconductive section was substantially the same in all areas. The porous material of the fiber collection tool 1 of the present Example had a plurality of pores including closed pores and open pores, and pores having pore diameters within a range of around 30 μm to 300 μm were present in a combined manner. The apparent density of the porous material was 0.143 g/cm$^3$, and the hardness of the porous material measured according to the aforementioned method was 50.2.

The fiber collection tool 1 was placed on the user's palm such that one of the fiber collection tool's principal surfaces was in contact with the palm of one of the user's hands, and the user held an electrospinning device 10 with the other hand, and in this state, electrospinning was performed with the nozzle facing the other principal surface of the fiber collection tool 1, to thereby form a porous film-like fiber deposit F on the surface of the fiber collection tool 1. The spinning conditions were as follows.

Spinning Conditions:

Spinning environment: 25° C., 50% RH

Material liquid for electrospinning: Mixed solution of polyvinyl butyral resin (12 mass %; S-LEC B BM-1 (product name) from Sekisui Chemical Co., Ltd.) and 99.5% ethanol (88 mass %).

Voltage applied to nozzle: 14.5 kV

Distance between nozzle and fiber collection tool 1: 80 mm

Material liquid ejection rate: 7.2 mL/h

Nozzle diameter: 0.7 mm

Example 1-2

A fiber deposit was produced as in Example 1-1, except that, for the fiber collection tool 1, a cosmetic sponge (Grade 402) from Nihon Puff was used. This fiber collection tool was a molded body of a porous and elastic material, constituted by a wet urethane-made porous body having a pair of 52-mm-dia. circular principal surfaces and a 7-mm-thick side surface. The electroconductive section of the fiber collection tool 1 of the present Example was formed over the entire surface thereof, and the surface electrical resistivity of the electroconductive section was substantially the same in all areas. The porous material of the fiber collection tool 1 of the present Example had a plurality of pores including closed pores and open pores, and pores having pore diameters within a range of around 30 μm to 300 μm were present in a combined manner. The apparent density of the porous material was 0.118 g/cm$^3$, and the hardness of the porous material measured according to the aforementioned method was 32.8.

Example 1-3

A fiber deposit was produced as in Example 1-1, except that, for the fiber collection tool 1, rubber (PRIFE-175) from Nishikawa Rubber Co., Ltd. was used. This fiber collection tool was a molded body of a porous and elastic material, constituted by a NBR-made porous body having a pair of rhombic principal surfaces, with a long side length of 52 mm and short side length of 44 mm, and 7-mm-thick side surfaces. The electroconductive section of the fiber collection tool 1 of the present Example was formed over the entire surface thereof, and the surface electrical resistivity of the electroconductive section was substantially the same in all areas. The porous material of the fiber collection tool 1 of the present Example had a plurality of pores including closed pores and open pores, and pores having pore diameters of around 250 μm were present. The apparent density of the porous material was 0.137 g/cm$^3$, and the hardness of the porous material measured according to the aforementioned method was 58.2.

Example 1-4

A fiber deposit was produced as in Example 1-1, except that, for the fiber collection tool 1, a cosmetic sponge (Yukilon Grace MG) from Yukigaya Chemical Industry Co., Ltd. was used. This fiber collection tool was a molded body of a porous and elastic material constituted by a porous body made from NBR subjected to a hydrophilizing treatment (described as "Hydrophilic NBR" in the Table) and having a pair of rhombic principal surfaces, with a side length of 48 mm, and 15-mm-thick side surfaces. The electroconductive section of the fiber collection tool 1 of the present Example was formed over the entire surface thereof, and the surface electrical resistivity of the electroconductive section was substantially the same in all areas. The porous material of the fiber collection tool 1 of the present Example had a plurality of pores including closed pores and open pores, and pores having pore diameters within a range of around 40 μm to 300 μm were present in a combined manner. The apparent density of the porous material was 0.155 g/cm$^3$, and the hardness of the porous material measured according to the aforementioned method was 26.4.

Example 1-5

A fiber deposit was produced as in Example 1-1, except that, for the fiber collection tool 1, an electroconductive rubber sheet (RBDHB) from Misumi Inc. was used. This fiber collection tool was a molded body made from NBR subjected to an electroconductive treatment (described as "Electroconductive NBR" in the Table) and having a pair of square principal surfaces, with a side length of 100 mm, 2-mm-thick side surfaces, and rounded apexes and ridgelines. The electroconductive section of the fiber collection tool 1 of the present Example was formed over the entire surface thereof, and the surface electrical resistivity of the electroconductive section was substantially the same in all areas. The hardness of the fiber collection tool 1 of the present Example measured according to the aforementioned method was 98.

Example 1-6

A fiber deposit was produced as in Example 1-1, except that, for the fiber collection tool 1, a melamine foam from MonotaRO Co., Ltd. was used. This fiber collection tool was a molded body of a porous and elastic material, constituted by a melamine resin-made porous body and having a pair of 80-mm-long, 50-mm-wide rectangular principal surfaces and 30-mm-thick side surfaces. The electroconductive section of the fiber collection tool 1 of the present Example was formed over the entire surface thereof, and the surface electrical resistivity of the electroconductive section was substantially the same in all areas. The porous material of the fiber collection tool 1 of the present Example had a plurality of pores including closed pores and open pores, and pores having pore diameters of around 200 μm were present. The apparent density of the porous material was 0.009 g/cm$^3$, and the hardness of the porous material measured according to the aforementioned method was 69.

Comparative Example 1-1

A fiber deposit was produced as in Example 1-1, except that, for the fiber collection tool 1, an Est Liquid sponge from Inoac Corporation was used. This fiber collection tool was a molded body of a porous and elastic material, constituted by a NBR-made porous body having a pair of rhombic principal surfaces, with a side length of 49 mm, and 18-mm-thick side surfaces. The electroconductive section of the fiber collection tool 1 of the present Example was formed over the entire surface thereof, and the surface electrical resistivity of the electroconductive section was substantially the same in all areas. The porous material of the fiber collection tool 1 of the present Example had a plurality of pores including closed pores and open pores, and pores having pore diameters within a range of around 100 μm to 330 μm were present in a combined manner. The apparent density of the porous material was 0.157 g/cm$^3$, and the hardness of the porous material measured according to the aforementioned method was 23.

Comparative Example 1-2

A fiber deposit was produced as in Example 1-1, except that, for the fiber collection tool 1, a natural rubber-based sponge (model number: NRS-01) from Wakisangyo Co., Ltd. was used. This fiber collection tool was a molded body of a porous and elastic material, constituted by a NR-made porous body having a pair of square principal surfaces, with a side length of 100 mm, and 5-mm-thick side surfaces. The electroconductive section of the fiber collection tool 1 of the present Example was formed over the entire surface thereof, and the surface electrical resistivity of the electroconductive section was substantially the same in all areas. The porous material of the fiber collection tool 1 of the present Example had a plurality of pores including closed pores and open pores, and pores having pore diameters within a range of around 100 μm to 300 μm were present in a combined manner. The apparent density of the porous material was 0.070 g/cm$^3$, and the hardness of the porous material measured according to the aforementioned method was 89.2.

Comparative Example 1-3

A fiber deposit was produced as in Example 1-1, except that, for the fiber collection tool 1, a cosmetic sponge (Marshmallow Mousse-touch Puff) from Chantilly Co., Ltd. was used. This fiber collection tool was a molded body of a porous and elastic material, constituted by a SBR-made porous body having a pair of 90-mm-dia. circular principal surfaces and a 15-mm-thick side surface. The electroconductive section of the fiber collection tool 1 of the present Example was formed over the entire surface thereof, and the surface electrical resistivity of the electroconductive section was substantially the same in all areas. The porous material of the fiber collection tool 1 of the present Example had a plurality of pores including closed pores and open pores, and pores having pore diameters within a range of around 100 μm to 410 μm were present in a combined manner. The apparent density of the porous material was 0.090 g/cm$^3$, and the hardness of the porous material measured according to the aforementioned method was 9.

Measurement of Surface Electrical Resistivity Value:

The surface electrical resistivity value of each of the fiber collection tools used in the Examples and Comparative Examples was measured according to the aforementioned method. The results are shown in Table 1.

Evaluation of Spinnability (1):

The following criteria (1) were employed to evaluate, by visual observation, the spinnability of fiber formed when the respective fiber collection tools of the Examples and Comparative Examples were used to electrospin a fiber toward the centroid, and vicinity thereof, of a principal surface of the fiber collection tool serving as the collection surface. The results are shown in Table 1.

Criteria for Evaluating Spinnability (1):

5: Very good spinnability; able to collect and deposit fiber concentratedly in the centroid, and vicinity thereof, of the collection surface of the fiber collection tool.

4: Good spinnability; able to collect and deposit fiber on the collection surface of the fiber collection tool.

3: Satisfactory spinnability, although fiber was collected and deposited on the side surface(s) in addition to the collection surface of the fiber collection tool.

2: Poor spinnability; the spun fiber scattered to the surrounding and was not collected on the fiber collection tool.

1: Very poor spinnability; fiber was repelled by the fiber collection tool and spun like being returned to the electrospinning device side.

TABLE 1

| | | Example 1-1 | Example 1-2 | Example 1-3 | Example 1-4 | Example 1-5 | Example 1-6 | Comp. Example 1-1 | Comp. Example 1-2 | Comp. Example 1-3 |
|---|---|---|---|---|---|---|---|---|---|---|
| Fiber collection tool | Material | NBR | Wet urethane | NBR | Hydrophilic NBR | Electro-conductive NBR | Melamine foam | NBR | NR | SBR |
| | Surface electrical resistivity (Ω/cm$^2$) | 1.51E+10 | 6.79E+09 | 2.00E+10 | 1.65E+08 | 6.73E+05 | 3.78E+08 | 2.65E+13 | 8.11E+13 | 1.19E+14 |
| Evaluation of spinnability | | 3 | 5 | 3 | 5 | 5 | 4 | 2 | 1 | 1 |

Table 1 shows that the fiber collection tools of the Examples, each including an electroconductive section having a surface electrical resistivity value of $10^{11}$ Ω/cm$^2$ or less on the surface thereof, are superior in fiber spinnability compared to the fiber collection tools of the Comparative Examples, and fiber deposits with predetermined shapes can be formed easily.

Examples 2-1 to 2-15

A cosmetic sponge (product name "Yukilon"; raw material: NBR) from Yukigaya Chemical Industry Co., Ltd. was subjected to a hydrophilizing treatment, and this was used as a fiber collection tool. The hydrophilizing treatment was performed by immersing the entire cosmetic sponge in respective surfactant solutions with compositions shown in Table 2 for 30 minutes, and then sufficiently air-drying the same. In this way, a hydrophilic section was formed on the entire surface of the fiber collection tool. That is, the contact angle with water was substantially the same at any section of the fiber collection tool. This fiber collection tool was an elastic molded body, constituted by a NBR-made porous body and having a pair of 50-mm-long, 50-mm-wide rectangular principal surfaces and 8-mm-thick side surfaces. The fiber collection tool 1 of the present Example had a plurality of pores including closed pores and open pores, and pores having pore diameters within a range of around 40 μm to 300 μm were present in a combined manner. The apparent density of the fiber collection tool 1 was 0.124 g/cm$^3$, and the hardness of the porous body measured according to the aforementioned method was 30.

The following substances were used for the surfactants and solvents shown in Table 2 below.

Cationic surfactant: distearyldimonium chloride (product name "Varisoft TA-100" from Evonik Industries)

Anionic surfactant: triethanolamine N-cocoyl glutamate (30% aqueous solution; product name "Amisoft CT-12S" from Ajinomoto Co., Inc.)

Nonionic surfactant: polyoxyethylene hydrogenated castor oil (product name "Emanon CH-60" from Kao Corporation)

Amphoteric surfactant: lauryl betaine (product name "Amphitol 20BS" from Asahi Kasei Corporation)

Ethanol (Ethanol (99.5) Guaranteed Reagent from Japan Synthetic Alcohol Co., Ltd.)

Comparative Example 2-1

A fiber collection tool was obtained as in Example 2-1, except that, instead of the aforementioned hydrophilizing treatment, a treatment was performed wherein the entire cosmetic sponge was immersed for 30 minutes in purified water and then the fiber collection tool was taken out and sufficiently air-dried.

Comparative Example 2-2

A fiber collection tool was obtained as in Example 2-1, except that, instead of the aforementioned hydrophilizing treatment, a treatment was performed wherein the entire cosmetic sponge was immersed for 30 minutes in ethanol and then the fiber collection tool was taken out and sufficiently air-dried.

Comparative Example 2-3

A fiber collection tool was obtained as in Example 2-1, except that the aforementioned hydrophilizing treatment was not performed.

Measurement of Contact Angle with Water:

The water contact angle of each of the fiber collection tools of Examples 2-1 to 2-15 and Comparative Examples 2-1 to 2-3 was measured according to the aforementioned method. The results are shown in Table 2.

Measurement of Water Absorption Time:

The water absorption time at 25° C. of each of the fiber collection tools of Examples 2-1 to 2-15 and Comparative Examples 2-1 to 2-3 was measured according to the aforementioned method. The results are shown in Table 2.

Measurement of Content of Surfactant in Fiber Collection Tool:

The content of surfactant in each of the fiber collection tools of Examples 2-1 to 2-15 was found by measuring the mass (a) of each fiber collection tool before immersion in the surfactant solution and the mass (b) of the fiber collection tool after immersion and sufficient air-drying treatment, and performing calculation according to the formula [(b)−(a)]/(b)×100. The results are shown in Table 2.

Evaluation of Spinnability (2):

The respective fiber collection tools of the Examples and Comparative Examples were used to electrospin a fiber toward the centroid, and vicinity thereof, of a principal surface of the fiber collection tool serving as the collection surface. More specifically, the fiber collection tool 1 was placed on the user's palm such that one of the fiber collection tool 1's principal surfaces was in contact with the palm of one of the user's hands, and the user held an electrospinning device 10 with the other hand, and in this state, electrospinning was performed with the nozzle facing the other principal surface of the fiber collection tool 1, to thereby form a porous fiber deposit F on the surface of the fiber collection tool 1. The spinning conditions were the same as in Example 1-1.

The maximum length of the fiber deposit obtained according to the aforementioned spinning conditions was measured, and the area of a circle having a diameter equivalent to the maximum length was calculated as the area of the fiber deposit (referred to hereinafter as "spinning area"). It can be evaluated that, the smaller the spinning area, the better the spinnability. For Examples 2-1 to 2-15 and Comparative Examples 2-1 to 2-3, spinnability was evaluated according to the following criteria (2) based on the spinning area. The evaluation results are shown in Table 2 together with the respective spinning area.

Criteria for Evaluating Spinnability (2):

1: The spinning area was 75% or greater with respect to the spinning area of Comparative Example 3.

2: The spinning area was 50% or greater to less than 75% with respect to the spinning area of Comparative Example 3.

3: The spinning area was 25% or greater to less than 50% with respect to the spinning area of Comparative Example 3.

4: The spinning area was less than 25% with respect to the spinning area of Comparative Example 3.

TABLE 2

| | Example 2-1 | Example 2-2 | Example 2-3 | Example 2-4 | Example 2-5 | Example 2-6 | Example 2-7 | Example 2-8 | Example 2-9 |
|---|---|---|---|---|---|---|---|---|---|
| Cation surfactant (g) | 0.01 | 0.10 | 1.00 | 10.00 | — | — | — | — | — |
| Anion surfactant (g) | — | — | — | — | 0.10 | 1.00 | 10.00 | — | — |
| Nonionic surfactant (g) | — | — | — | — | | — | — | 0.10 | 1.00 |
| Amphoteric surfactant (g) | — | — | — | — | — | — | — | — | — |
| Purified water (g) | — | — | — | — | 0.20 | 2.30 | 23.30 | — | — |
| Ethanol (g) | 99.99 | 99.90 | 99.00 | 90.00 | 99.70 | 96.67 | 66.67 | 99.90 | 99.00 |
| Total | 100.00 | 100.00 | 100.00 | 100.00 | 100.00 | 100.00 | 100.00 | 100.00 | 100.00 |
| Surfactant concentration (mass %) | 0.01 | 0.10 | 1.00 | 10.00 | 0.10 | 1.00 | 10.00 | 0.10 | 1.00 |
| Contact angle with water (°) | 89.3 | 51.6 | 37.1 | 18.4 | 73.4 | 39.2 | 35.0 | 41.2 | 39.4 |
| Time for absorbing 0.1 mL of water | 3 h | 2 h 30 min | 2 h 10 min | 10 sec | 2 h 20 min | 1 h 50 min | 0 sec | 3 h 20 min | 80 sec |
| Content of surfactant in fiber collection tool (mass %) | 0.13 | 0.53 | 3.75 | 29.27 | 0.48 | 4.31 | 5.46 | 0.58 | 4.56 |

TABLE 2-continued

| | | | | | | | | | |
|---|---|---|---|---|---|---|---|---|---|
| Spinning area ($cm^2$) | 415.3 | 379.9 | 283.4 | 176.6 | 379.9 | 201.0 | 153.9 | 452.2 | 346.2 |
| Evaluation of spinnability | 2 | 2 | 3 | 3 | 2 | 3 | 4 | 2 | 3 |

| | Example 2-10 | Example 2-11 | Example 2-12 | Example 2-13 | Example 2-14 | Example 2-15 | Comp. Example 2-1 | Comp. Example 2-2 | Comp. Example 2-3 |
|---|---|---|---|---|---|---|---|---|---|
| Cation surfactant (g) | — | — | — | — | — | — | — | — | — |
| Anion surfactant (g) | — | — | — | — | — | — | — | — | — |
| Nonionic surfactant (g) | 10.00 | — | — | — | — | — | — | — | — |
| Amphoteric surfactant (g) | — | 0.01 | 0.05 | 0.10 | 1.00 | 10.00 | — | — | — |
| Purified water (g) | — | — | — | — | — | — | 100.00 | — | — |
| Ethanol (g) | 90.00 | 99.99 | 99.95 | 99.90 | 99.00 | 90.00 | — | 100.00 | — |
| Total | 100.00 | 100.00 | 100.00 | 100.00 | 100.00 | 100.00 | 100.00 | 100.00 | 0.00 |
| Surfactant concentration (mass %) | 10.00 | 0.01 | 0.05 | 0.10 | 1.00 | 10.00 | — | — | — |
| Contact angle with water (°) | 45.5 | 84.4 | 71.6 | 20.0 | 34.4 | 34.1 | — | — | 101.2 |
| Time for absorbing 0.1 mL of water | 20 sec | 2 h 30 min | 40 min | 15 min | 2 sec | 1 sec | Over 6 hours | Over 6 hours | Over 6 hours |
| Content of surfactant in fiber collection tool (mass %) | 26.94 | 0.06 | 0.13 | 0.17 | 2.30 | 16.31 | — | — | — |
| Spinning area ($cm^2$) | 132.7 | 379.9 | 346.2 | 201.0 | 153.9 | 132.7 | 615.4 | 706.5 | 706.5 |
| Evaluation of spinnability | 4 | 2 | 3 | 3 | 4 | 4 | 1 | 1 | — |

Table 2 shows that the fiber collection tools of the Examples, each having on its surface a hydrophilic section having a water contact angle of from 15° to 90° at 25° C., are superior in fiber spinnability compared to the fiber collection tools of the Comparative Examples. Further, the results show that the water absorption time, when 0.1 mL of water was dropped at 25° C., decreased with an increase in the content of the surfactant, and also the spinning area decreased with an increase in the content of each surfactant. Further, the spinning area decreased with a decrease in the contact angle with water, indicating an improvement in spinnability. This effect, however, saturated when the contact angle decreased to a certain level. The fiber collection tools of the Examples were capable of transferring the entire fiber deposit onto a transfer-target object more easily compared to those of the Comparative Examples.

Example 3-1

A cosmetic sponge (product name "Yukilon Grace MG") from Yukigaya Chemical Industry Co., Ltd. was prepared as the fiber collection tool 1. This fiber collection tool was an elastic molded body, constituted by a NBR-made porous body and having a pair of 60-mm-long, 65-mm-wide rectangular principal surfaces and 15-mm-thick side surfaces. The fiber collection tool had a plurality of pores including closed pores and open pores, and pores having pore diameters within a range of around 40 μm to 300 μm were present in a combined manner. The apparent density of the porous body was 0.155 $g/cm^3$, and the hardness of the porous body measured according to the aforementioned method was 26.4. The fiber collection tool of the present Example had a plurality of depressions over its entire surface.

The fiber collection tool 1 was placed on the user's palm such that one of the fiber collection tool's principal surfaces was in contact with the palm of one of the user's hands, and the user held an electrospinning device 10 with the other hand, and in this state, electrospinning was performed with the nozzle facing the other principal surface of the fiber collection tool 1, to thereby form, on the surface of the fiber collection tool 1, a film F constituted by a porous circular fiber deposit having a diameter of about 3 cm. The spinning conditions were as follows.

Spinning Conditions:

Spinning environment: 25° C., 50% RH

Material liquid for electrospinning: Mixed solution of polyvinyl butyral resin (12 mass %; S-LEC B BM-1 (product name) from Sekisui Chemical Co., Ltd.) and 99.5% ethanol (88 mass %)

Voltage applied to nozzle: 14.5 kV

Distance between nozzle and fiber collection tool 1: 80 mm

Material liquid ejection rate: 7.2 mL/h

Nozzle diameter: 0.7 mm

Spinning time: 5 seconds

After forming the film F, the user pressed the fiber collection tool 1, having the film F formed thereon, against his/her cheek, to thereby transfer the film F onto the cheek.

Example 3-2

A film F was formed and the film was transferred onto the user's cheek as in Example 3-1, except that, for the fiber collection tool 1, a cosmetic puff (product name "Puff for Face Powder") from Tokyo Puff Co., Ltd. was used. This fiber collection tool was an elastic molded body, constituted by a polyester-made porous body having a pair of 90-mm-dia. circular principal surfaces and a 15-mm-thick side surface. The fiber collection tool of the present Example had a napped section over the entire surface of the porous body, and the hardness measured according to the aforementioned method was 17.

Example 3-3

A film F was formed and the film was transferred onto the user's cheek as in Example 3-1, except that, for the fiber collection tool 1, a rubber container (product name "Clean Knoll Nitrile Short Gloves") from AS ONE Corporation was used, and an agent having a film-releasing action was applied to the fiber collection tool 1. The rubber container was a product ordinarily used as a glove. The interior of the glove was filled with 200 mL of water from the opening for inserting the hand and the glove was sealed in this state, to produce a fiber collection tool having an electroconductive section in the interior thereof. This fiber collection tool was a nitrile-made elastic molded body having a pair of 75-mm-dia. circular principal surfaces and a 50-mm-thick side surface. The fiber collection tool of the present Example did not have any depressions on the surface thereof. For the agent having a film-releasing action, talc (product name "SI-Talc JA-46R" from Miyoshi Kasei, Inc.) was used. This agent was applied to the entire fiber collection tool before forming the film F.

Example 3-4

A film F was formed and the film was transferred onto the user's cheek as in Example 3-3, except that, before transferring the filer F, an agent for increasing adhesiveness between the object and the film F was applied to the user's cheek. Cosmetic A was used for the agent for increasing adhesiveness between the object and the film F. The composition of Cosmetic A is shown in Table 3 below. The table also shows details (mass %) of the components shown in Table 3.

TABLE 3

| Cosmetic A | | |
|---|---|---|
| Glycerin | 86% Glycerin V, Kao Corporation | 15% |
| Dimethicone | Silicone KF-96A-10CS (-G), Shin-Etsu Chemical Co., Ltd. | 5% |
| BG | 1,3-Butylene glycol-P, KH Neochem Co., Ltd. | 5% |
| Neopentyl glycol dicaprate | Estemol N-01, Nisshin Oillio Group, Ltd. | 5% |
| Cetyl-PG hydroxyethyl palmitamide | Sphingolipid E, Kao Corporation | 2% |
| Glyceryl behenate | Sunsoft No. 8100-CK, Taiyo Kagaku Co., Ltd. | 1% |
| Cetanol | Cetyl Alcohol NX, Kokyu Alcohol Kogyo Co., Ltd. | 1% |
| Stearoyl glutamate | Amisoft HA-P, Ajinomoto Co., Inc. | 1% |
| Water | | Balance |

Example 3-5

A film F was formed and the film was transferred onto the user's cheek as in Example 3-1, except that, before transferring the film F, Cosmetic A was applied to the user's cheek.

Example 3-6

A film F was formed and the film was transferred onto the user's cheek as in Example 3-5, except that the film F was transferred onto a test desk instead of the user's cheek.

Example 3-7

A film F was formed and the film was transferred onto the user's cheek as in Example 3-3, except that no agent having a film-releasing action was applied to the fiber collection tool 1.

Example 3-8

A film F was formed and the film was transferred onto the user's cheek as in Example 3-4, except that, before transferring the film F, Cosmetic B was applied to the user's cheek. Cosmetic B is an agent for increasing adhesiveness between an object and the film F; while Cosmetic A is a moisturizer-like liquid agent, Cosmetic B is a toner-like liquid agent and thus has less adhesiveness than Cosmetic A. The composition of Cosmetic B is shown in Table 4 below. The table also shows details (mass %) of the components shown in Table 4.

TABLE 4

| Cosmetic B | | |
|---|---|---|
| Glycerin | 86% Glycerin V, Kao Corporation | 15% |
| BG | 1,3-Butylene glycol-P, KH Neochem Co., Ltd. | 5% |
| Water | | Balance |

Evaluation of Transferring Properties:

A test was repeated five times, wherein a film F formed on a collection surface of a fiber collection tool was pressed against a transfer-target object to see whether the film F could be transferred or not. Then, based on the number of times that transferring of the entire film F onto the transfer-target object succeeded, the transferring properties were evaluated according to the following criteria. The evaluation results are shown in Table 5.

Criteria for Evaluating Transferring Properties:

A: Transferring succeeded four or more times

B: Transferring succeeded two to three times.

C: Transferring succeeded once.

D: Transferring succeeded zero times.

Evaluation of Finish:

Films for which transferring succeeded in the aforementioned Evaluation of Transferring Properties were observed with the eyes, to evaluate their appearance. Films that were transferred in their entirety and that had no unnatural appearance earned 3 points, whereas films that were partially transferred earned 2 points. For films for which transferring succeeded two or more times, the arithmetic mean value of the evaluation score (points) of each film was calculated. Then, the finish was evaluated according to the following criteria. The evaluation results are shown in Table 5.

Criteria for Evaluating Finish:

A: Evaluation score was from 2.8 to 3 points.

B: Evaluation score was from 2.3 to 2.7 points.

C: Evaluation score was from 2.0 to 2.2 points.

Evaluation of Convenience:

The convenience/easiness of the transferring process was evaluated according to the following criteria, based on the number of steps in the series of processes from formation of the film F using the fiber collection tool 1 to transferring of the film F onto a transfer-target object. Depending on the Examples, the process not only included a film formation step for forming the film F using the fiber collection tool 1 and a transferring step for pressing the fiber collection tool against a transfer-target object and transferring the film F onto the object, but also included a step for applying, to the fiber collection tool, an agent having a film-releasing action, or a step for applying, to the transfer-target object, an agent for increasing adhesiveness between the object and the film F. The evaluation results are shown in Table 5.

Criteria for Evaluating Convenience:

A: There were 2 steps or less.

B: There were 3 steps or more.

TABLE 5

| | | Example 3-1 | Example 3-2 | Example 3-3 | Example 3-4 | Example 3-5 | Example 3-6 | Example 3-7 | Example 3-8 |
|---|---|---|---|---|---|---|---|---|---|
| Fiber collection tool | Surface depressions | Yes | No | No | No | Yes | Yes | No | No |
| | Napped section | No | Yes | No | No | No | No | No | No |
| | Agent having action of releasing film | No | No | Yes | No | No | No | No | No |
| Object | | Skin | Skin | Skin | Skin | Skin | Non-skin | Skin | Skin |
| Agent for increasing adhesiveness between object and film | | No | No | No | Cosmetic A | Cosmetic A | Cosmetic A | No | Cosmetic B |
| Evaluation of transferring properties | | A | A | A | B | A | A | C | C |
| Evaluation of finish | | B | B | A | C | A | C | C | C |
| Evaluation of convenience | | A | A | B | B | B | B | A | B |

As shown in Table 5, in all the Examples, it was possible to transfer the film F onto the transfer-target object. Particularly, the results of Examples 3-1, 3-2, 3-5, and 3-6 show that, in cases of using fiber collection tools having depressions or napped sections on the surface thereof, the number of times that transferring of the film F succeeded was large, and excellent transferring properties and finish were achieved.

A comparison between Example 3-1 and Example 3-5 shows that, for fiber collection tools having depressions on the surface thereof, it is effective to apply, to the object's surface, an agent for increasing adhesiveness between the object and the film in advance.

The results of Examples 3-3, 3-4, 3-7, and 3-8 show that, for fiber collection tools that do not have depressions on the surface thereof, it is effective to apply an agent having a film-releasing action to the fiber collection tool's surface, or apply in advance, to the object's surface, an agent for increasing adhesiveness between the object and the film.

Further, the results show that all the Examples were able to transfer the film in a few steps and had excellent convenience.

INDUSTRIAL APPLICABILITY

The present invention provides a fiber deposit production method which enables electrospinning of fiber to be performed in a hand-held state and is thus highly convenient, offers excellent fiber spinnability, and provides a fiber deposit having excellent transferability.

The present invention also provides a film production method and a film attachment method which enable a user to produce a desired film by himself/herself and which are less limited in terms of areas where the film can be attached.

The invention claimed is:

1. A method for producing a fiber deposit, comprising:

collecting a fiber with a fiber collection tool, the fiber being spun by a user by performing electrospinning using an electrospinning device; and producing a deposit of the fiber on a surface of the fiber collection tool, wherein:

the fiber collection tool includes, in at least a portion of the surface thereof, an electroconductive section having a surface electrical resistivity of $10^{11}$ Ω/cm$^2$ or less; and the method comprises collecting the fiber in the electroconductive section in a state where a portion of the user's body is in contact with a portion of the electroconductive section, or in a state where a portion of an electric conductor is in contact with the electroconductive section and a portion of the user's body is in contact with another portion of the electric conductor.

2. The method for producing a fiber deposit according to claim 1, wherein the fiber is collected in the electroconductive section in a state where the user holds the electrospinning device with one hand, and wherein the other hand is in contact with the electroconductive section of the fiber collection tool.

3. The method for producing a fiber deposit according to claim 1, wherein the fiber is collected in the electroconductive section in a state where the user holds the electrospinning device with one hand, and wherein the other hand is in contact with the electric conductor and the electric conductor is in contact with the electroconductive section of the fiber collection tool.

4. The method for producing a fiber deposit according to claim 1, wherein the fiber collection tool has a surface electrical resistivity of $10^{11}$ Ω/cm$^2$ or less at a discretionary position on the surface thereof.

5. The method for producing a fiber deposit according to claim 1, wherein the fiber collection tool includes a porous material.

6. The method for producing a fiber deposit according to claim 1, wherein the fiber collection tool has elasticity.

7. A method for producing a fiber deposit, comprising:

collecting a fiber with a fiber collection tool, the fiber being spun by a user by performing electrospinning using an electrospinning device; and producing a deposit of the fiber on a surface of the fiber collection tool, wherein:

the fiber collection tool includes a hydrophilic section in at least a portion of the surface thereof, and has elasticity along a direction in which the fiber is collected and deposited, and wherein electrospinning is performed in a state where the user holds the electrospinning device with one hand and holds the fiber collection tool with the other hand, and wherein an electrical conduction path passing through the user's body is formed between the electrospinning device and the fiber collection tool, or wherein electrospinning is performed in a state where the user holds the electrospinning device with one hand and holds an electric conductor with the other hand with the electric conductor in contact with the fiber collection tool, and wherein an electrical conduction path passing through the user's body and the electric conductor is formed between the electrospinning device and the fiber collection tool.

8. The method for producing a fiber deposit according to claim 7, wherein the hydrophilic section has a water contact angle of from 15° to 90° at 25° C.

9. The method for producing a fiber deposit according to claim 7, wherein a water absorption time of the hydrophilic section when 0.1 mL of water is dropped at 25° C. is from 0 seconds to 4 hours.

10. The method for producing a fiber deposit according to claim 7, wherein electrospinning is performed in a state where the user holds the electrospinning device with one hand and holds the fiber collection tool with the other hand, and wherein an electrical conduction path passing through the user's body is formed between the electrospinning device and the fiber collection tool.

11. The method for producing a fiber deposit according to claim 7, wherein electrospinning is performed in a state where the user holds the electrospinning device with one hand and holds an electric conductor with the other hand with the electric conductor in contact with the fiber collection tool, and wherein an electrical conduction path passing through the user's body and the electric conductor is formed between the electrospinning device and the fiber collection tool.

12. The method for producing a fiber deposit according to claim 7, wherein the fiber collection tool includes a porous material.

13. The method for producing a fiber deposit according to claim 7, wherein a surfactant is present in the fiber collection tool.

14. A method for producing, on a surface of an object, a film constituted by a fiber deposit, the method comprising:

collecting, with a fiber collection tool, a fiber spun by a user by performing electrospinning using an electrospinning device, and forming a film including a deposit of the fiber on a surface of the fiber collection tool; and pressing the fiber collection tool, having the film formed thereon, against a surface of an object and transferring the film onto the surface of the object, to form the film including the fiber deposit on the surface of the object, wherein the fiber collection tool includes, in at least a portion of the surface thereof, an electroconductive section, and wherein electrospinning is performed in a state where the user holds the electrospinning device with one hand and holds the fiber collection tool with the other hand, and wherein an electrical conduction path passing through the user's body is formed between the electrospinning device and the fiber collection tool, or wherein electrospinning is performed in a state where the user holds the electrospinning device with one hand and holds an electric conductor with the other hand with the electric conductor in contact with the fiber collection tool, and wherein an electrical conduction path passing through the user's body and the electric conductor is formed between the electrospinning device and the fiber collection tool.

15. The method for producing a fiber deposit according to claim 14, wherein:

one or both of the electrospinning device and the fiber collection tool has/have a size holdable by the user's hand;

the user collects the fiber with the fiber collection tool, and forms the film including the fiber deposit on the surface of the fiber collection tool; and the user presses the fiber collection tool, having the film formed thereon, against the surface of the object.

16. The method for producing a fiber deposit according to claim 14, wherein the fiber collection tool has, in the surface thereof, one or a plurality of depressions.

17. The method for producing a fiber deposit according to claim 14, wherein the fiber collection tool has, on the surface thereof, a section including napped fiber.

18. The method for producing a fiber deposit according to claim 14, wherein the fiber collection tool has, on the surface thereof, an agent having an action of releasing the film.

19. The method for producing a fiber deposit according to claim 14, the method further comprising:

applying in advance, to the surface of the object, an agent for increasing adhesiveness between the object and the film, and in this state, pressing the fiber collection tool, having the film formed thereon, against the surface of the object.

20. A method for attaching a film, comprising:

collecting, with a fiber collection tool, a fiber spun by a user by performing electrospinning using an electrospinning device, and forming a film including a deposit of the fiber on a surface of the fiber collection tool; and pressing the fiber collection tool, having the film formed thereon, against a surface of an object and attaching the film onto the surface of the object, wherein the fiber collection tool includes, in at least a portion of the surface thereof, an electroconductive section, and wherein electrospinning is performed in a state where the user holds the electrospinning device with one hand and holds the fiber collection tool with the other hand, and wherein an electrical conduction path passing through the user's body is formed between the electrospinning device and the fiber collection tool, or wherein electrospinning is performed in a state where the user holds the electrospinning device with one hand and holds an electric conductor with the other hand with the electric conductor in contact with the fiber collection tool, and wherein an electrical conduction path passing through the user's body and the electric conductor is formed between the electrospinning device and the fiber collection tool.

21. The method for producing a fiber deposit according to claim 14, wherein the film formed on the surface of the fiber collection tool has a higher adhesiveness to the object than the adhesiveness to the fiber collection tool.

* * * * *